United States Patent [19]

Kurematsu et al.

[11] Patent Number: 4,749,642

[45] Date of Patent: Jun. 7, 1988

[54] PROCESSING OF COLOR PHOTOGRAPHIC MATERIAL UTILIZING A STABILIZING SOLUTION AFTER FIXING

[75] Inventors: Masayuki Kurematsu; Shigeharu Koboshi, both of Hino, Japan

[73] Assignee: Konishiroku Photo Industry Co., Ltd., Tokyo, Japan

[21] Appl. No.: 21,532

[22] Filed: Feb. 26, 1987

[51] Int. Cl.[4] ..... G03C 7/40; G03C 5/24; G03C 11/00; G03C 7/26

[52] U.S. Cl. ..... 430/372; 430/428; 430/429; 430/432; 430/463; 430/551

[58] Field of Search ..... 430/372, 551, 428, 429, 430/432, 463

[56] References Cited

U.S. PATENT DOCUMENTS 3,647,460 3/1972 Hofman et al. ..... 430/372

*Primary Examiner*—Mukund J. Shah

*Attorney, Agent, or Firm*—Frishauf, Holtz, Goodman & Woodward

[57] ABSTRACT

A method for processing a light-sensitive silver halide color photographic material by processing a light-sensitive silver halide color photographic material with a processing solution having a fixing ability and subsequently processing the fixed material with a water washing-substitutive stabilizing solution substantially without carrying out washing with water, which comprises carrying out processing with the water washing-substitutive stabilizing solution which has been subjected to concentration regulating treatment in the presence of at least one of the compounds represented by the following formulae [I], [II], [II'] and [II'']:

Formula [I]

Formula [II]

Formula [II']

Formula [II'']

19 Claims, 2 Drawing Sheets

PROCESSING OF COLOR PHOTOGRAPHIC MATERIAL UTILIZING A STABILIZING SOLUTION AFTER FIXING

This application is a continuation, of application Ser. No. 811,000, filed Dec. 19, 1985 now abandoned.

BACKGROUND OF THE INVENTION

This invention relates to a method for processing of a light-sensitive silver halide color photographic material (hereinafter referred to as a light-sensitive material), particularly to a stabilizing processing method which performs substantially no water washing step subsequent to the desilverization step.

In recent years, in a photo-finisher which performs automatically and continuously the developing processing of a light-sensitive material, the problems of conservation of environment and water resource are of particularly important concern, and it has been desired that the great amount of water to be used in the step of washing with water subsequent to fixing or bleach-fixing processing should be reduced or made zero. For this purpose, there have been proposed techniques in which direct stabilizing processing is conducted without washing with water after processing of fixing or bleach-fixing. For example, Japanese Unexamined Patent Publications Nos. 8542/1982, 132146/1982, 14834/1982, 18631/1983 disclose techniques to perform processing with stabilizing solutions containing isothiazoline derivatives, benzisothiazoline derivatives, soluble iron complexes, polycarboxylic acids, organic phosphonic acids.

These techniques concern the methods for inhibition or prevention of the problems generated by the fixing or bleach-fixing components brought about by the light-sensitive material into the water washing-substitutive stabilizing solution (herein meant to be a stabilizing solution which may be used as a substitute for water washing), but any technique cannot be practically provided for use at a certain level or higher of the fixing and bleach-fixing components, and a supplemental amount of the stabilizing solution is required to be used at a certain level or higher. Particularly, if the fixing and bleach-fixing component concentration in the final bath for the water washing-substitutive stabilizing solution is increased, there is involved the drawback that yellow stain at the unexposed portion of a light-sensitive material due to storage for a long term will be increased.

Accordingly, as the method for overcoming the above problems, the present inventors have proposed the methods according to concentration regulating treatment of the water washing-substitutive stabilizing solution as disclosed in Japanese Patent Application Nos. 77813/1984, 96350/1984, 96352/1984 and 119153/1984.

However, as a new problem, it has been found that practice of the above concentration regulating treatment will result in formation of a thin film on the surface of the water washing-substitutive stabilizing solution, when it is left to stand for a long term after continuous processing in an automatic developing machine, etc. Such a thin film is not only unfavorable in appearance, but also ensues a problem that it is attached on the light-sensitive material.

SUMMARY OF THE INVENTION

Accordingly, a first object of this invention is to provide a method for processing a light-sensitive silver halide color photographic material which is free from any problem even when the water washing-substitutive stabilizing solution is left to stand for a long term.

The present inventors have made intensive studies to find that the above object can be accomplished by a method for processing a light-sensitive material by processing a light-sensitive material with a processing solution having a fixing ability and subsequently processing the fixed material with a water washing-substitutive stabilizing solution substantially without carrying out washing with water, which comprises carrying out processsing with the water washing-substitutive stabilizing solution which has been subjected to concentration regulating treatment in the presence of at least one of the compounds represented by the following formulae [I], [II], [II'] and [II"]:

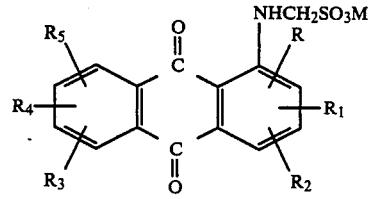

Formula [I]

wherein R, $R_1$, $R_2$, $R_3$, $R_4$ and $R_5$ each represent a hydrogen atom, a halogen atom,, a hydroxy group, an alkyl group, an alkoxy group, a sulfo group or $-NHCH_2SO_3^M$ (M represents a cation),

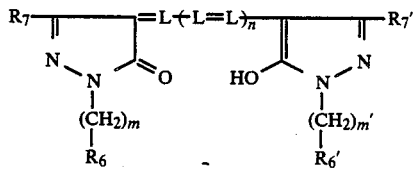

Formula [II]

wherein $R_6$ and $R_6'$ each represent a hydrogen atom, an alkyl group, an aryl group or a heterocyclic group; $R_7$ and $R_7'$ each represent a hydroxy group, an alkoxy group, a substituted alkoxy group, a cyano group, a trifluoromethyl group, $-COOR_8$, $-CONHR_8$, $-NHCOR_8$, an amino group, a substituted amino group substituted with an alkyl group having 1 to 4 carbon atoms or a cyclic amino group represented by the formula:

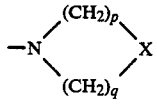

(where p and q each represent 1 or 2, and X represents an oxygen atom, a sulfur atom or $-CH_2-$); $R_8$ represents a hyrogen atom, an alkyl group or an aryl group; L represents a methyne group; n represents 0, 1 or 2; m and m' each represent 0 or 1,

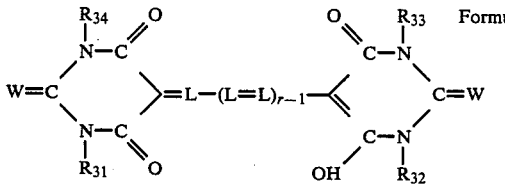

Formula [II']

wherein r represents an integer of 1 to 3; W represents an oxygen atom or a sulfur atom; L represents a methyne group; $R_{31}$ to $R_{34}$ each represent a hydrogen atom, an alkyl group, an aryl group, an aralkyl group or a heterocyclic group, at least one of which is a substituent other than hydrogen atom, Formula [II"]

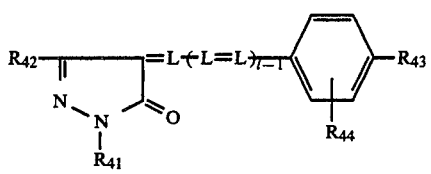

wherein l represents an integer of 1 or 2; L represents a methyne group; $R_{41}$ represents an alkyl group, an aryl group or a heterocyclic group; $R_{42}$ represents a hydroxy group, an alkyl group, an alkoxy group, a substituted alkoxy group, a cyano group, a trifluoromethyl group, $—COOR_8$, $—CONHR_8$, $—NHCOR_8$, an amino group, a substituted amino group substituted with an alkyl group having 1 to 4 carbon atoms or a cyclic amino group represented by the formula:

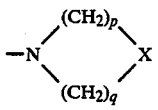

(where p and q each represent 1 or 2, and X represents an oxygen atom, a sulfur atom or a $—CH_2—$ group); $R_8$ represents a hyrogen atom, an alkyl group or an aryl group; $R_{43}$ represents $—OZ_1$ or

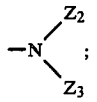

$Z_1$, $Z_2$ and $Z_3$ each represent a hydrogen atom or an alkyl group, $Z_2$ and $Z_3$ being either the same or different or alternatively being bonded to each other to form a ring; and $R_{44}$ represents a hydrogen atom, an alkyl group, a chlorine atom or an alkoxy group.

According to a preferred embodiment of this invention, there is employed at least one system of [A] to [D] shown below as the aforesaid concentration regulating treatment method, and the object of this invention can be accomplished more effectively according to this embodiment:

System [A]: the system of contacting with an ion-exchange resin;

System [B]: the system of performing electrodialysis treatment;

System [C]: the system of performing reverse osmosis treatment;

System [D]: the system of bringing the water washing-substitutive stabilizing solution into contact with at least one of the substances represented by (a) to (i) shown below:

[Contacting substances]

(a) activated charcoal;
(b) clay substance;
(c) polyamide type polymeric compound;
(d) polyurethane type polymeric compound;
(e) phenol resin;
(f) epoxy resin;
(g) polymeric compound having hydrazide group;
(h) polymeric compound containing polytetrafluoroethylene;
(i) copolymer of mono-methacrylate with monohydric or polyhydric alcohol and poly-methacrylate with polyhydric alcohol.

As a more preferable embodiment, the processing solution having fixing ability contains a thiosulfate and this invention can act effectively against the drawback as mentioned above thereby generated.

DESCRIPTION OF THE PREFERRED EMBODIMENTS

Figure 1:
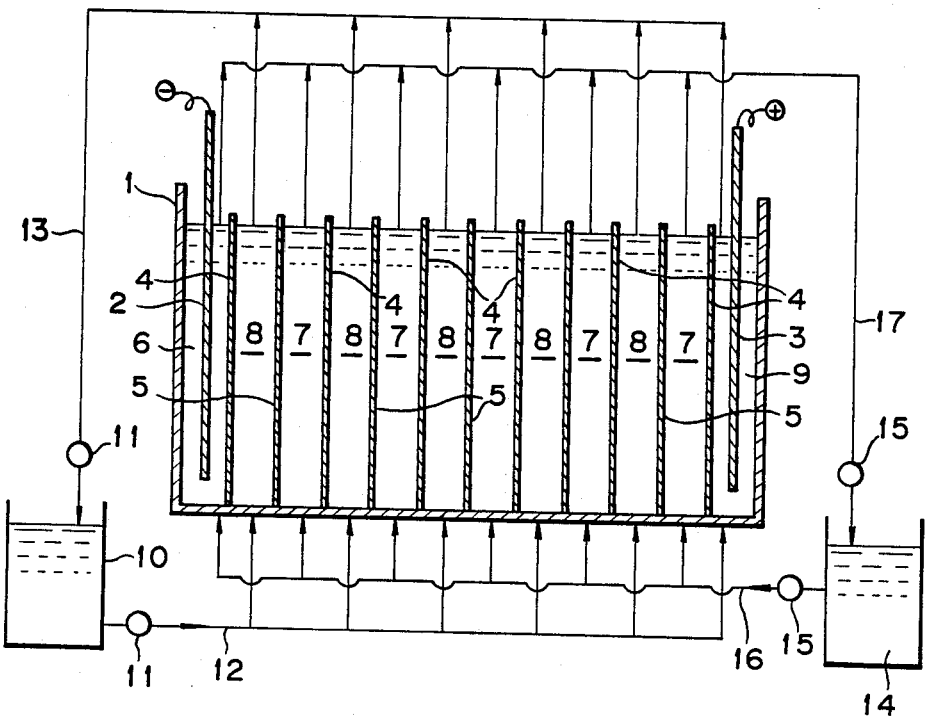
FIG. 1 is a schematic flow chart showing an example of the processing method of this invention by use of an electrodialytic device.

When the conventional final step of water washing processing is replaced with the stabilizing processing as substitute for water washing processing, it has been found that fixing components will be entrained into the water washing-substitutive stabilizing solution, resulting particularly in increased yellow stain of the image obtained by processing of the light-sensitive material during storage in a dark place. As the technique for preventing such yellow stain, the above-mentioned concentration regulating treatment method has been proposed, but the present inventors have found that there is involved the drawback of formation of a thin film on the liquid surface, when a water washing-substitutive stabilizing solution is left to stand for a long term.

The present inventors have made intensive studies and found that the compounds as represented by the formulae [I], [II], [II'] and [II"] known as dyes to be used for light-sensitive materials have the effects against such drawbacks. It is surprising enough to find that, of the dyes used for light-sensitive materials, the compounds represented by the formulae [I], [II], [II'] and [II"] can act effectively on the above drawbacks. Further, it has also been found that the above drawbacks are great when a thiosulfate is used in a fixing solution, and this invention can be more effective against such drawbacks.

Next, the compounds represented by the above formulae [I], [II], [II'] and [II"] are to be described.

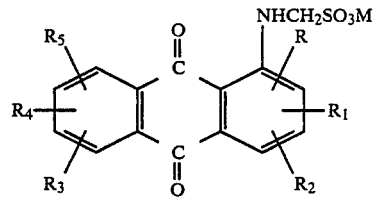

wherein R, $R_1$, $R_2$, $R_3$, $R_4$ and $R_5$ each represent a hydrogen atom; a halogen atom (e.g. chlorine atom, bromine atom, fluorine atom); a hydroxy group; an alkyl group having 2 to 4 carbon atoms (e.g. methyl group, ethyl group, propyl group); an alkoxy group (e.g. methoxy group, ethoxy group, propoxy group); $—SO_3^M$; or $—NHCH_2SO_3M$ where M represents a cation and may be an alkali metal (e.g. sodium atom, potassium atom); ammonium or an organic ammonium (e.g. pyridinium, piperidinium, triethyl ammonium, triethanolamine, etc.).

Typical examples of the compounds represented by the above formula [I] are shown below, by which this invention is not limited.

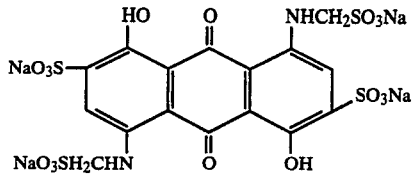
(A-1)

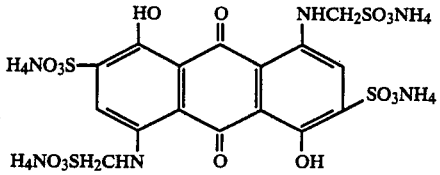
(A-2)

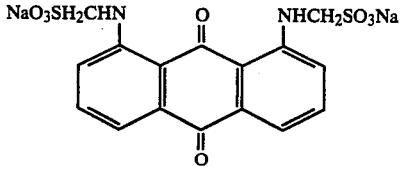
(A-3)

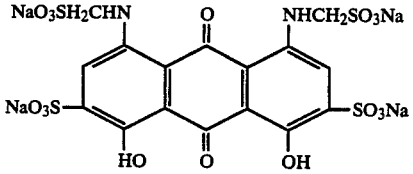
(A-4)

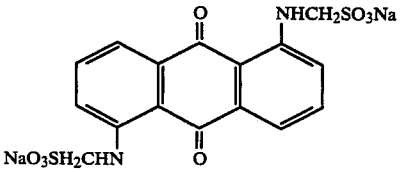
(A-5)

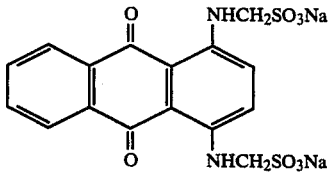
(A-6)

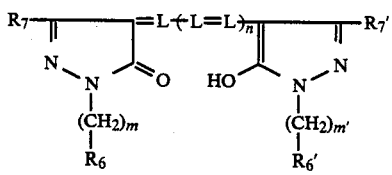
Formula [II]

Wherein, each of $R_6$ and $R_6'$ represents a hydrogen atom, or an alkyl group an aryl group or a heterocyclic group each of which may be substituted. The aryl group may include 4-sulfophenyl group, 4-(δ-sulfobutyl)phenyl group, 3-sulfophenyl group, 2,5-disulfophenyl group, 3,5-disulfophenyl group, 6,8-disulfo-2-naphthyl group, 4,8-disulfo-2-naphthyl group, 3,5-dicarboxyphenyl group, 4-carboxyphenyl group and the like, and such an aryl group can have a sulfo group, a sulfoalkyl group, a carboxyl group, an alkyl group having 1 to 5 carbon atoms (e.g. methyl group ethyl group, etc.), a halogen atom (e.g. chlorine atom, bromine atom etc.), an alkoxy group having 1 to 4 carbon atoms (e.g. methoxy group, ethoxy group etc.) or a phenoxy group, etc.

The sulfo group may be bonded to the aryl group through a divalent organic group, as exemplified by 4-(4-sulfophenoxy)phenyl group, 4-(2-sulfoethyl)phenyl group, 3-(sulfomethylamino)phenyl group, 4-(2-sulfoethoxy)phenyl group, etc.

The alkyl group represented by $R_6$, $R_6'$ may be either straight, branched or cyclic, preferably one having 1 to 4 carbon atoms, such as ethyl group, β-sulfoethyl group, etc.

The heterocyclic group may include, for example, 2-(6-sulfo)benzthiazolyl group, 2-(6-sulfo)benzoxazolyl group and the like, which may also have a substituent such as a halogen atom (e.g. fluorine atom, chlorine atom, bromine atom, etc.), an alkyl group (e.g. a methyl group, an ethyl group, etc.), an aryl group (e.g. a phenyl group, etc.), a carboxyl group, a sulfo group, a hydroxy group, an alkoxy group (e.g. a methoxy group, etc.), an aryloxy group (e.g. a phenoxy group, etc.).

Each of $R_7$ and $R_7'$ represents a hydroxy group; an alkoxy group having 1 to 4 carbon atoms (e.g. a methoxy group, an ethoxy group, an isopropoxy group, an n-butyloxy group); a substituted alkoxy group such as an alkoxy group having 1 to 4 carbon atoms substituted with a halogen atom or an alkoxy group having up to 2 carbon atoms (e.g. a β-chloroethoxy group, a β-methoxyethoxy group, etc.); a cyano group; a trifluoromethyl group; —$COOR_8$; —$CONHR_8$; —$NHCOR_8$ ($R_8$ represents a hydrogen atom; an alkyl group having 1 to 4 carbon atoms; or an aryl group such as a phenyl group, a naphthyl group, said alkyl group and aryl group optionally having a sulfo group or a carboxy group as the substituent); an amino group; a substituted amino group substituted with an alkyl group having 1 to 4 casrbon atoms (e.g. an ethylamino group, a dimethylamino group, a diethylamino group, a di-n-butylamino group); or a cyclic amino group represented by

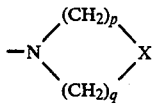

(where p and q represent an integer of 1 or 2), X represents an oxygen atom, a sulfur atom or —$CH_2$— group (e.g. a morpholino group, a piperizino group, a piperazino group).

The methyne group represented by L may be substituted with an alkyl group having 1 to 4 carbon atoms (e.g. a methyl group, an ethyl group, an isopropyl group, a t-butyl group, etc.) or an aryl group (e.g. a phenyl group, a tolyl group, etc.).

Also, at least one of the sulfo group, the sulfoalkyl group and the carboxy group may form a salt with an alkali metal (e.g. sodium, potassium), an alkaline earth metal (e.g. calcium, magnesium), ammonia or an organic base (e.g. diethylamine, triethylamine, morpholine, pyridine, piperidine, etc.). The symbol n represents 0, 1 or 2, while m and m' each represent 0 or 1.

Typical examples of the compounds represented by the above formula [II] are shown below, but this invention is not limited thereto.

Exemplary compounds:

(B-1)
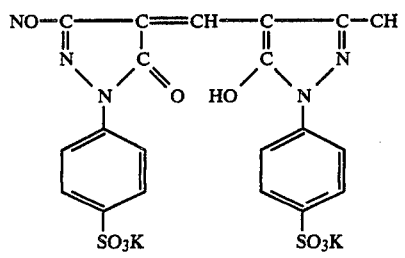
(B-2)
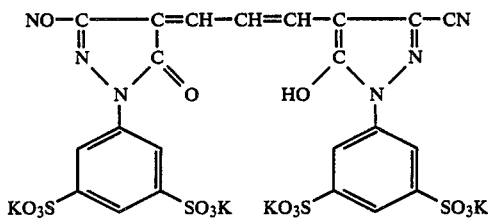
(B-3)
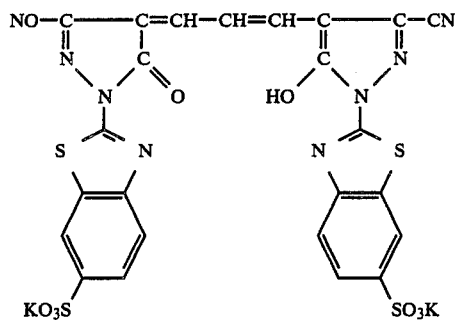
(B-4)
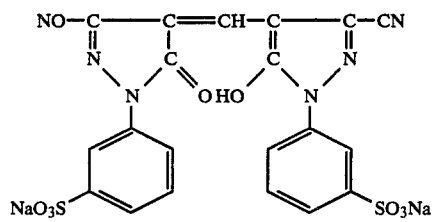
(B-5)
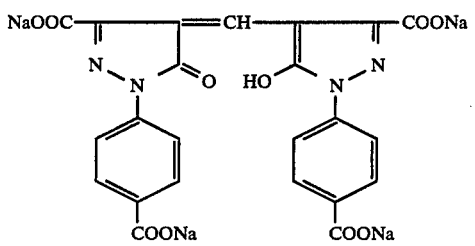
(B-6)
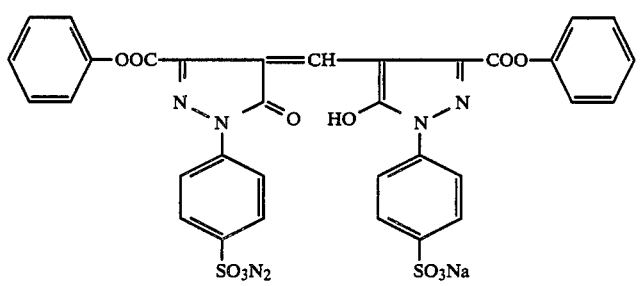

-continued
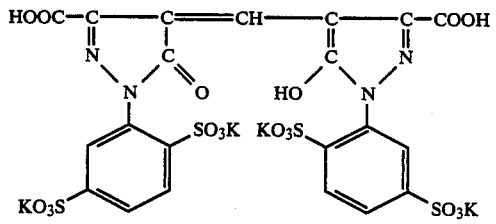
(B-7)
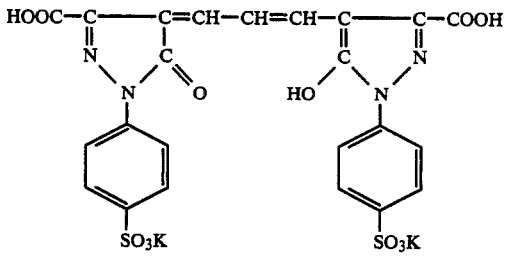
(B-8)
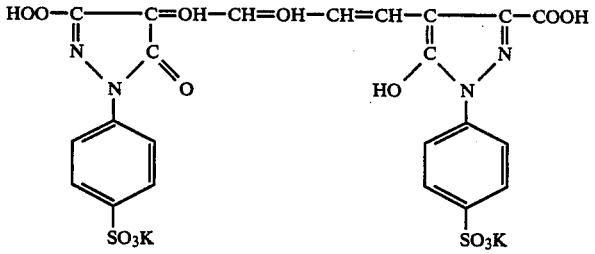
(B-9)
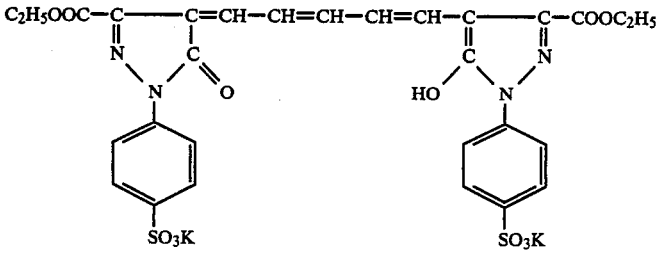
(B-10)
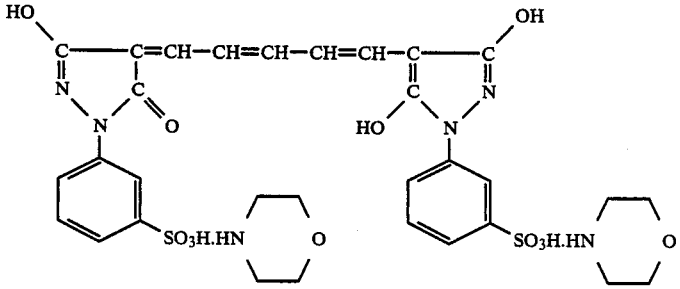
(B-11)
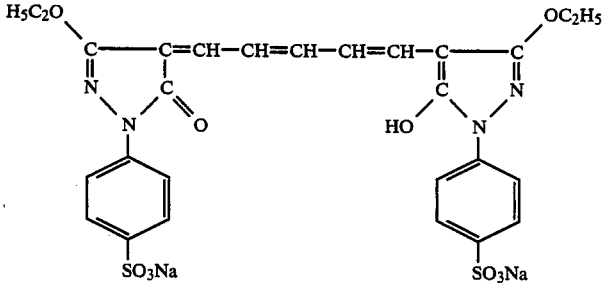
(B-12)

-continued
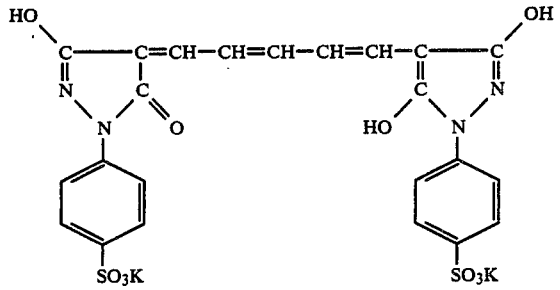
(B-13)
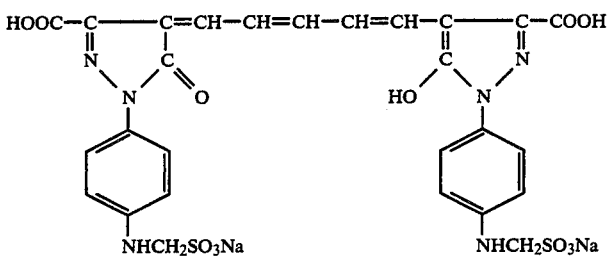
(B-14)
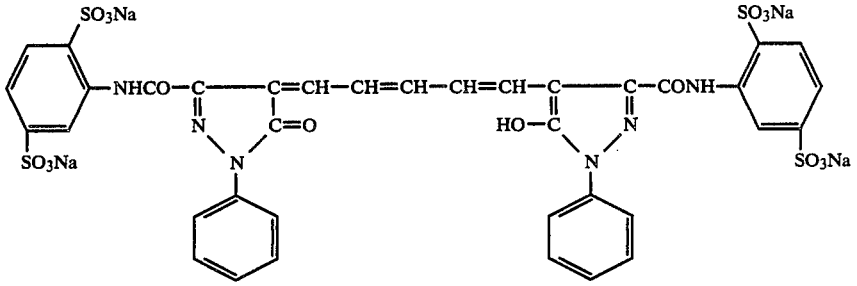
(B-15)
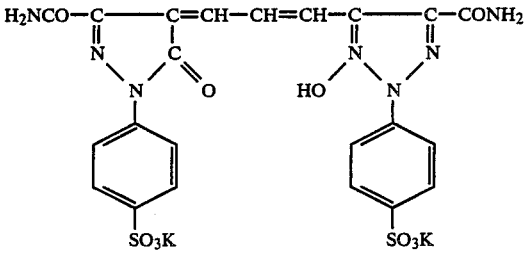
(B-16)
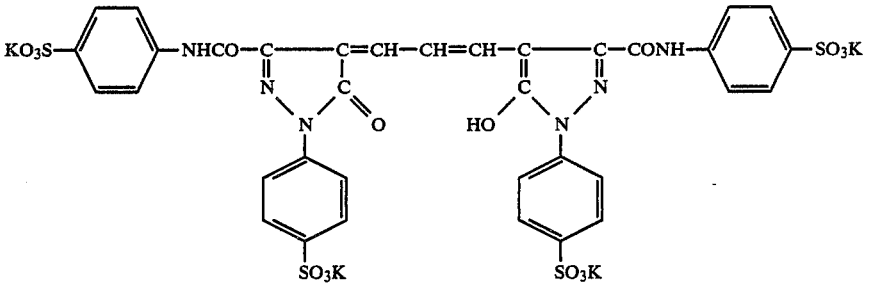
(B-17)
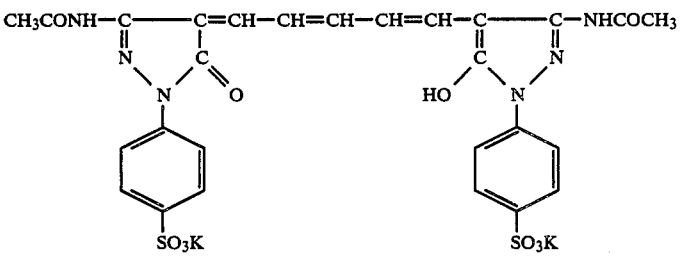
(B-18)

-continued
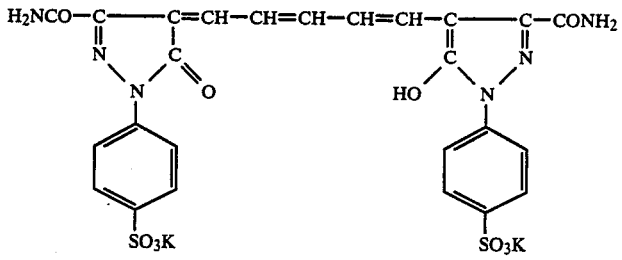
(B-19)
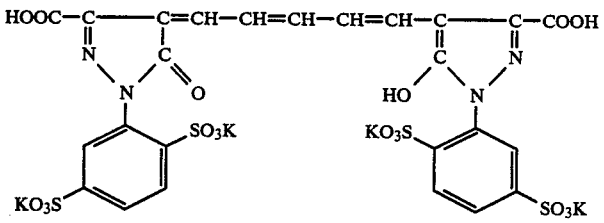
(B-20)
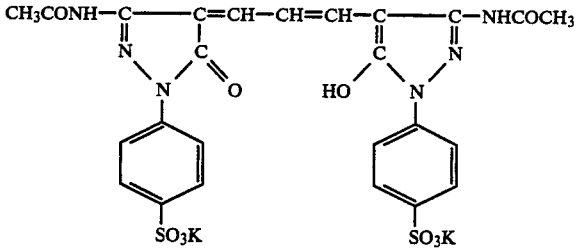
(B-21)
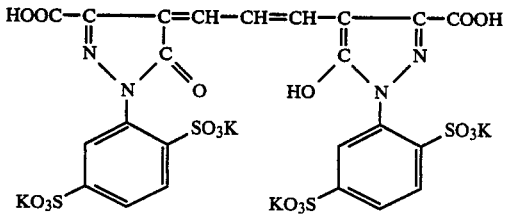
(B-22)
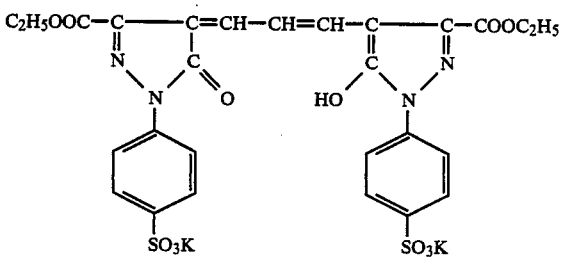
(B-23)
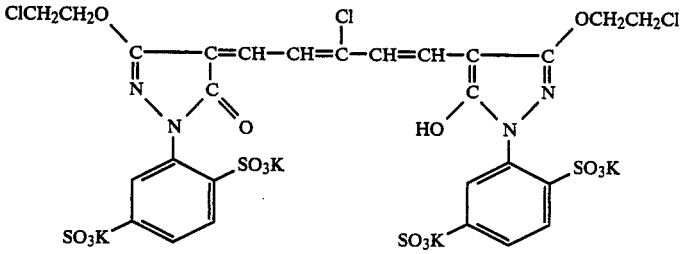
(B-24)

-continued (B-25)

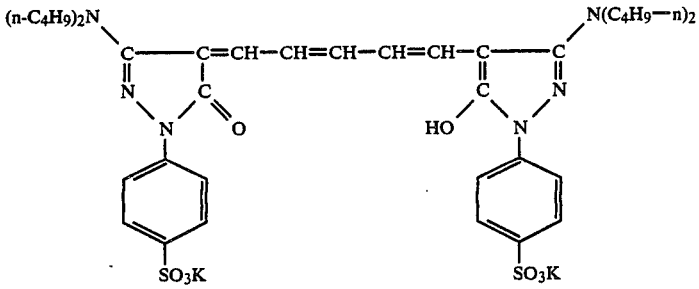

(B-26)

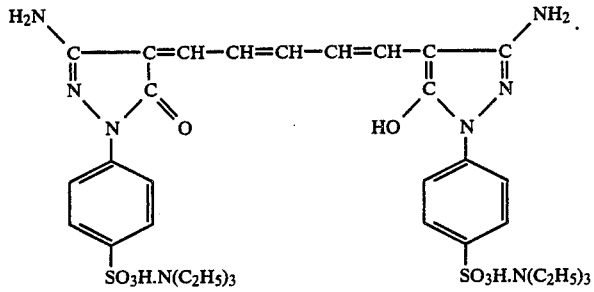

(B-27)

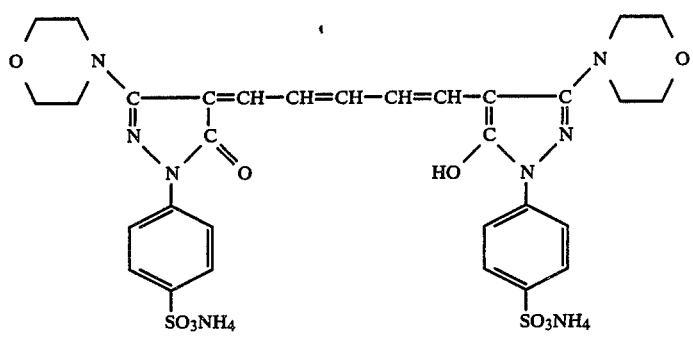

(B-28)

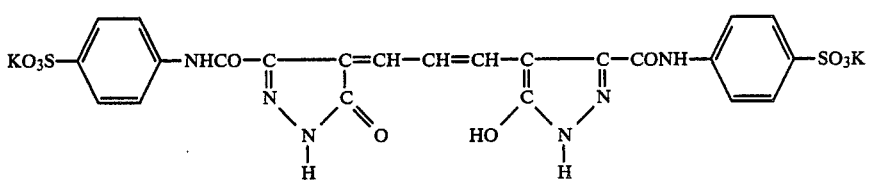

(B-29)

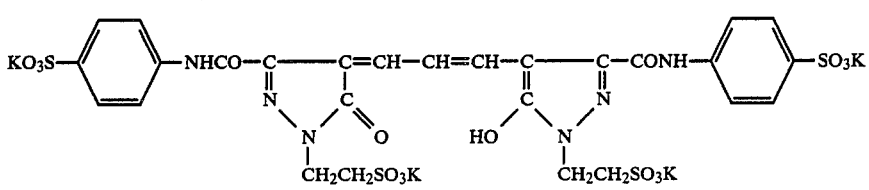

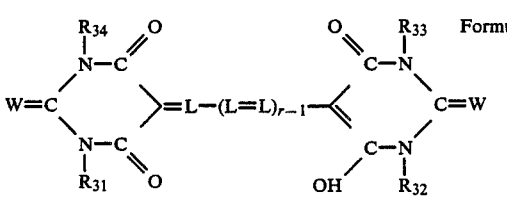

Formula [II']

wherein r represents an integer of 1 to 3, W represents an oxygen atom or a sulfur atom, L represents a methyne group, $R_{31}$ to $R_{34}$ each represent a hydrogen atom, an alkyl group, an aryl group, an aralkyl group, a heterocyclic group, at least one of which being substituents other than hydrogen atom.

The methyne group represented by L may include those as described above in the item of the formula [II].

The alkyl group represented by $R_{31}$ to $R_{34}$ may include the same as the alkyl group of $R_6$ and $R_6'$ shown in the item of the formula [II], and the alkyl group may have a substituent. The substituent may include various substituents to be introduced into the group of $R_6$ and $R_6'$ shown in the item of the formula [II], preferably sulfo, carboxy, hydroxy, alkoxy, alkoxycarbonyl, cyanol, sulfonyl group.

The aryl group represented by $R_{31}$ to $R_{34}$ may preferably be a phenyl group, and the substituent to be introduced into the phenyl group may include various substituents as mentioned as the substituent to be introduced into $R_6$ and $R_6'$ in the item of the formula [II], but it is preferred that the aromatic nucleus should have at least one of a sulfo group, a carboxy group and a sulfamoyl group.

The aralkyl group represented by $R_{31}$ to $R_{34}$ may preferably be a benzyl group or a phenethyl group, and the substitutuent to be introduced onto such an aromatic nucleus may include those as described above for the substituent of the aryl group of $R_{31}$ to $R_{34}$.

The heterocyclic group represented by $R_{31}$ to $R_{34}$ may include, for example, pyridyl, pyrimidyl, etc., and the substituent to be introduced onto such a heterocyclic ring may include those as described above for the substituent of the aryl group of $R_{31}$ to $R_{34}$.

The group represented by $R_{31}$ to $R_{34}$ may preferably be an alkyl group and an aryl group, and further it is desirable to have at least one group of carboxy, sulfo, sulfamoyl within the molecule of barbituric acid and thiobarbituric acid represented by the formula [II'], and a symmetric type compound is preferred.

In the following, specific examples of the compounds of the above formula [II'] are shown, but this invention is not limited thereto.

(C-1)

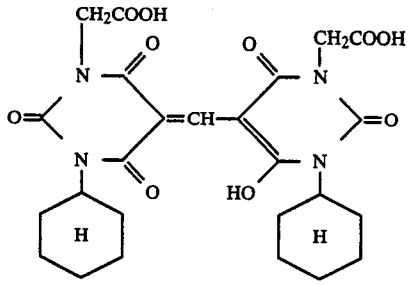

(C-2)

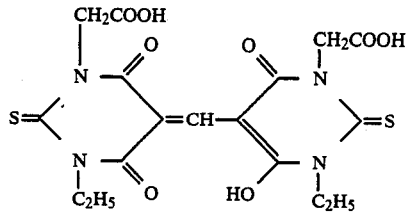

(C-3)

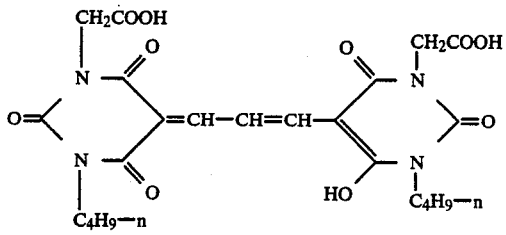

(C-4)

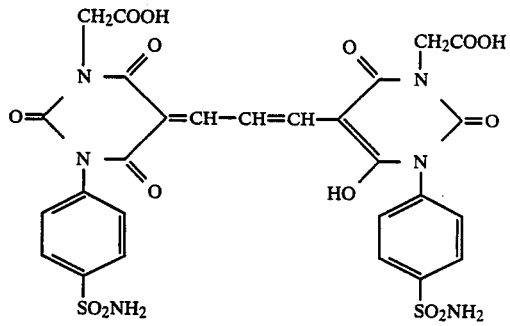

(C-5)

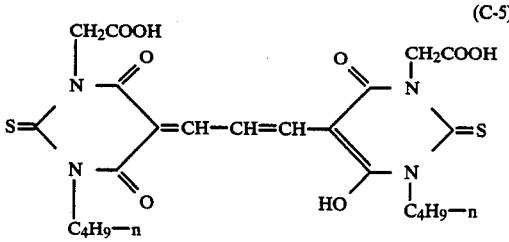

(C-6)

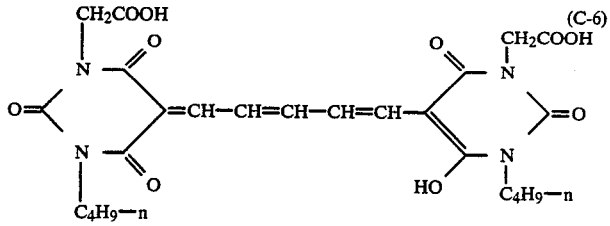

(C-7)

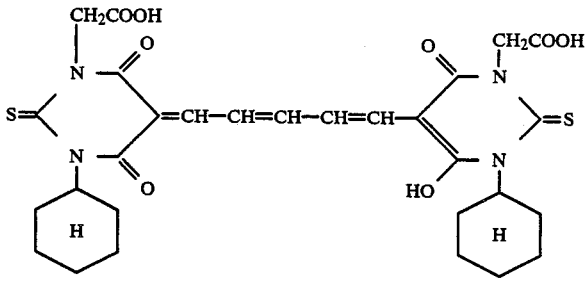

Formula [II'']

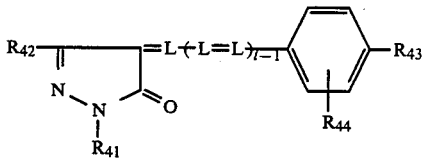

Wherein, 1 represents an integer of 1 or 2, L represents a methyne group, $R_{41}$ has the same meaning as $R_6$ and $R_6'$ in the formula [II], being perferably an alkyl group and an aryl group, said aryl group having desirably at least one sulfo group.

$R_{42}$ can introduce all of the substituents as shown for $R_7$ and $R_7'$ in the formula [II], selected preferably from an alkyl group, a carboxy group, an alkoxycarbonyl group, a carbamoyl group, an ureido group, an acylamino group, an imide group and cyano group.

$R_{43}$ represents $—OZ_1$ or

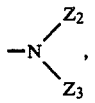

where $Z_1$, $Z_2$ and $Z_3$ each represent a hydrogen atom group, $Z_2$ and $Z_3$ being either the same or different, or alternatively bonded to each other to form a ring.

The alkyl group represented by $Z_1$, $Z_2$ and $Z_3$ may include, for example, a methyl group, an ethyl group, a butyl group, a hydroxyalkyl group (e.g. a hydroxyethyl ethyl), an alkoxyalkyl group (e.g. a β-ethoxyethyl group, etc.), a carboxyalkyl group (e.g. a β-carboxyethyl group, etc.), an alkoxycarbonyl alkyl group (e.g. a β-ethoxycarbonylethyl group, etc.), a cyanoalkyl group (e.g. a β-cyanoethyl group, etc.), a sulfoalkyl group (e.g. a γ-sulfopropyl, a β-sulfopropyl, etc.) and the like.

$Z_2$ and $Z_3$ may be bonded to each other to form a 5- or 6-membered ring, as exemplified by a morpholino group, a piperizino group, a pyrrolidino group etc.

$R_{44}$ represents a hydrogen atom, an alkyl group, a chlorine atom or an alkoxy group. The alkyl group may be exemplified, for example, a methyl group, an ethyl group, etc., and the alkoxy group may be exemplified, for example, a methoxy group, an ethoxy group, etc.

In the following, specific examples of the compounds of the formula [II''] are shown, but this invention is not limited thereto.

(D-1)

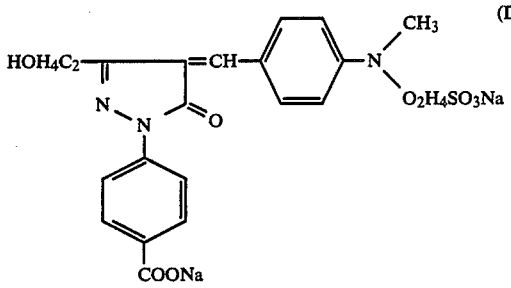

(D-2)

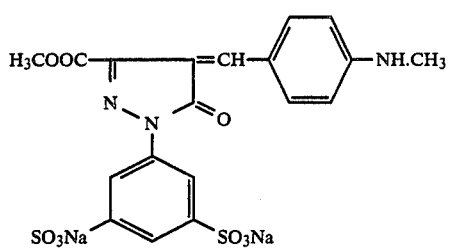

(D-3)

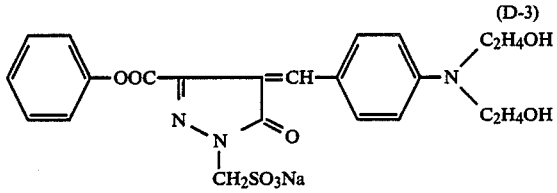

(D-4)

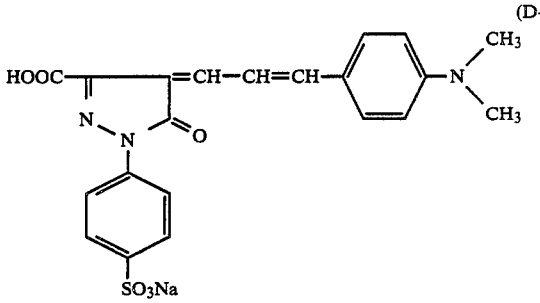

(D-5)

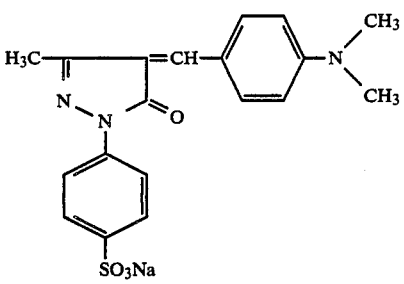

(D-6)

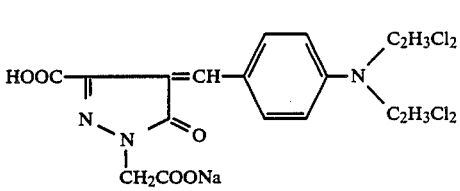

(D-7)

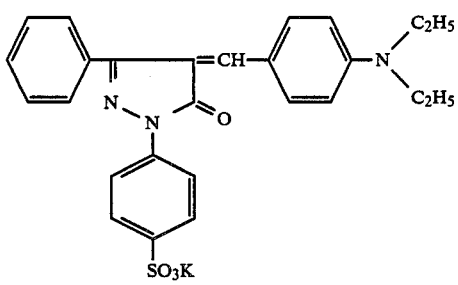

(D-8)

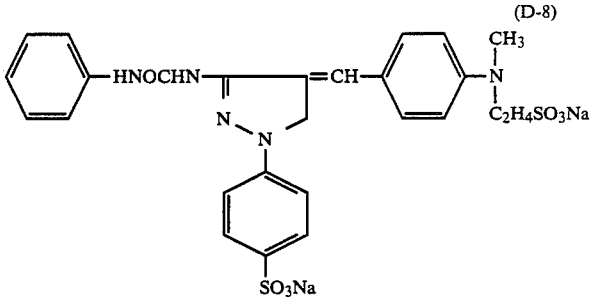

The compounds of the above formula [I], [II], [II'] or [II''] can be synthesized according to the synthetic methods as described in U.S. Pat. Nos. 3,575,704, 3,247,127, 3,540,887, 3,653,905, Japanese Unexamined Patent Publications Nos. 85130/1973, 99620/1974, 111640/1984, 111641/1984 and 170838/1984.

As the method for processing with a water washing-substitutive stabilizing solution by permitting a compound of the formula [I], [II], [II'] or [II''], it can be added directly to the water washing-substitutive stabilizing solution, or alternatively it can be added into the previous bath to be attached on the light-sensitive material and brought into the stabilizing bath. Further, it is practically preferred to incorporate it in the light-sensitive material, thereby permitting it to exist in the stabilizing solution. When it is to be incorporated in the light-sensitive material, it can be contained in either layer of a silver halide emulsion layer or otherwise hydrophilic colloid layer. Thus, an organic or inorganic alkali salt of the above compound of this invention is dissolved in water to prepare an aqueous dye solution with an appropriate concentration, which is then added to the coating solution and applied in a conventional manner to be incorporated in the photographic material. The content of these compounds of this invention may be controlled to 1 to 800 mg, preferably 2 to 200 mg, per $m^2$ of the light-sensitive material. When it is to be added into the water washing-substitutive stabilizing solution, its content to be added should preferably be 0.005 to 200 mg per liter of the solution, particularly 0.01 to 50 mg.

Of the compounds represented by the above formula [I], [II], [II'] or [II''], those represented by the formula [II] are more preferable. Also, these compounds may be used in a combination of two or more compounds.

When employing the method of incorporating the compound of the formula [I], [II], [II'] or [II''] of this invention in the light-sensitive material and permitting it to be dissolved out into the water washing-substitutive stabilizing solution, its concentration dissolved out will of course determined depending on the amount supplemented of the water washing-substitutive stabilizing solution per unit area of the photographic material, but it is also related to the processing time and the processing temperature of the pre-processing before the stabilizing processing for substituting water washing, namely processing with a color developing solution and a bleach-fixing solution.

When the processing time is longer and the processing temperature is higher for color developing and bleach-fixing solutions, the compound of this invention will be previously dissolved out to a disadvantage. Accordingly, the time for pre-processing before stabilizing processing should be within 8 minutes, desirably within 6 minutes, most preferably within 4 minutes and 30 seconds. The processing temperature should preferably be 50° C. or lower. As to the amount supplemented of the processing solutions in carrying out continuous processing, the total amount supplemented in the color developing step and the bleach-fixing step before the stabilizing processing for substituting water washing should preferably be one liter or less per $m^2$ of the light-sensitive material, more preferably 600 ml or less. The amount supplemented of the water washing-substitutive stabilizing solution should preferably 2 liters or less, more preferably one liter or less, most preferably 500 ml or less, per $m^2$ of the light-sensitive material.

When the compound of the formula [I], [II], [II'] or [II''] is incorporated in the light-sensitive material, the amount of the compound of the above formula [I], [II], [II'] or [II''] dissolved out in the water washing-substitutive stabilizing solution will be such corresponding to the same concentration as in the case of being added directly to the water washing-substitutive stabilizing solution, depending on the processing temperature, time and the amount supplemented as described above.

When the compound of the above formula [I], [II], [II'] or [II''] is added into the water washing-substitutive stabilizing solution, the above-mentioned processing time and supplemental amount pose no problem at all, and such a method is preferred from the standpoint of pollution and rapid processing.

The processing step with a processing solution having fixing ability in this invention refers to a step with the use of a fixing bath or a bleach-fixing bath, etc. intended to fixing of a light-sensitive material, which is ordinarily conducted after developing. The details about the processing solution having said fixing ability are described hereinbelow.

In this invention, processing with a processing solution having a fixing ability followed subsequently by substantially no water washing means that rinsing processing, or processing with auxiliary washing water and water washing promiting bath within a very short time by use of a single bath or a multi-tank countercurrent system may be possible, provided that the concentration of the fixing solution or bleach-fixing solution brought into the earliest tank for stabilizing processing will not become about 1/2000-fold or less in said tank.

In this invention, processing with a water washing-substitutive stabilizing solution refers to a processing for stabilizing processing by performing stabilizng processing immediately after processing with a processing solution having fixing ability substantially without carrying out water washing processing, the processing solution to be used for said stabilizing processing being referred to as the water washing-substitutive stabilizing solution and the processing tank as the stabilizing bath or stabilizing tank.

In this invention, stabilizing processing can be carried out by use of one tank or multiple tanks without any problem, but preferably with the use of 1 to 4 tanks, and the concentration regulating method may be practiced as desired in each tank.

The concentration regulating treatment in this invention refers to the treatment in which the bleaching and bleach-fixing components in the water washing-substitutive stabilizing solution are removed so that the concentrations of said components may be maintained at a certain level or lower which does not give rise to troubles such as yellow stain, etc. due to said components.

As the concentration regulating treatment method, there may be included the aforesaid systems [A] to [D] as preferable ones, which, however, are not limitative of the invention.

The ion-exchange resin to be used in the above system [A] comprises a three-dimensionally polycondensed polymeric substrate to which functional groups are bonded, including cation exchange resins, anion exchange resins, chelate resins, adsorptive resins, etc. The polymeric substrate may be, for example, copolymers of styrene with divinylbenzene, methacrylate or acrylate with divinylbenzene, phenol-formalin resin, etc. The functional groups may include, for example, sulfonic acid group, carboxylic acid group, phosphonic acid group in the case of cation exchange resins; quaternary ammonium group, primary to tertiary amine salt structures in the case of anion exchange resins; and iminodiacetic acid type, polyamine type, amidoxime type, aminophosphoric acid type, pyridine type, dithiocarbamic acid type in the case of chelate resins. There are also absorptive resins having no functional group. The polymeric substrates and the functional groups are not limited to those as mentioned above.

The above ion-exchange resins are commercially sold and available under various names such as Diaion produced by Mitsubishi Kasei Kogyo Co., Amberlite produced by Organo Co., Duorite, Sumikaion, Sumichelate produced by Sumitomo Kagaku Kogyo Co., Uniselec produced by Unitica Co., etc.

Among the above ion-exchange resins of this invention, particularly preferable ion-exchange resins with respect to the effect of this invention asre anion exchange resins, specific chemical structure of which are enumerated below.

Strongly basic ion-exchange resin:

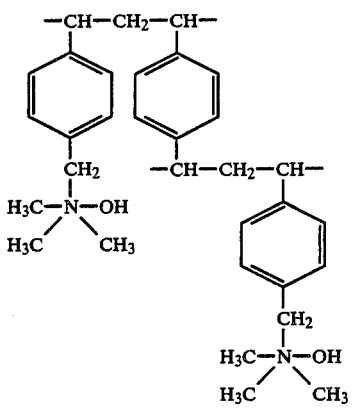

(1)

Trade names: Mitsubishi Diaion SA-10A, SA-11A, SA-12A, PA-306, PA-308, PA-312, PA-316, PA-318, Organo Amberlite IRA-400, IRA-401, IRA-402, IRA-900, IRA-904, IRA-938, Sumitomo Duorite A-1010, A-103, A-104, A-109, A-161, A-171P.

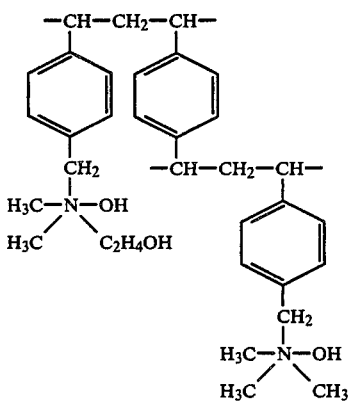

(2)

Trade names: Mitsubishi Diaion SA-20A, SA-21A, PA-406, PA-408, PA-412, PA-416, PA-418, Organo Amberlite IRA-410, IRA-411, IRA-910, IRA-911, Sumitomo Duorite A-102D, A-162.

Weakly basic ion-exchange resin:

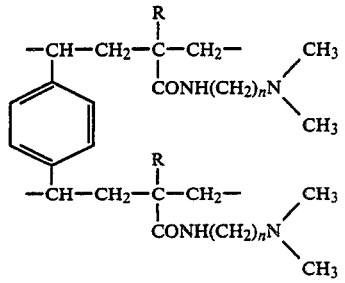

(1)

wherein R is a hydrogen atom, $N(R')_2$ or a lower alkyl group (where R' is a hydrogen atom or a lower alkyl group, but the case when both are hydrogen atoms is excluded); and n is an integer of 0 to 3.

Trade names: Mitsubishi Diaion wA-10, wA-11.

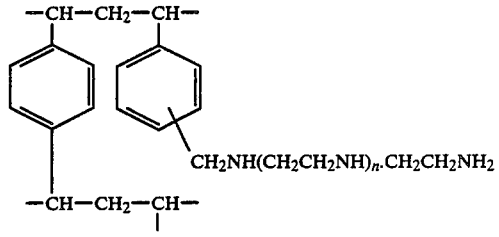

(n is 0 to 1)

Trade names: Mitsubishi Diaion wA-20, wA-21.

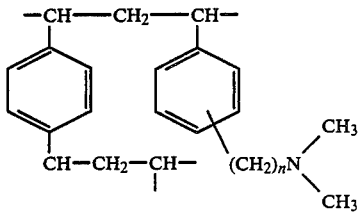

(3)

(n is 1 to 3)

Trade names: Mitsubishi Diaion wA-30, Organo Amberlite IRA-93, IRA-94.

These basic ion-exchange resins may be substituted with anions which are not particularly limited, but preferably $OH^-$, $Cl^-$, $SO_4^{2-}$, $Br^-$, $COOH^-$, $CO_3^{2-}$, $SO_3^{2-}$.

The electrodialytic treatment of the above system [B] is carried out by introducing the stabilizing solution into a chamber partitioned with a diaphragm between the cathode and the anode in an electrodialytic cell and passing direct current between the electrodes.

Prefeably, the diaphragm may be an ion-exchange membrane. More preferably, the space between the cathode and the anode is partitioned alternately with anion exchange membranes and cation exchange membranes to provide a cathode chamber, a plurality of concentration chambers (chambers partitioned with an anion exchange membrane on the cathode side and a cation exchange membrane on the anode side), a plurality of desalting chambers (chambers partitioned with a cation exchange membrane on the cathode side asnd an anion exchange membrane on the anode side) and an anode chamber. The stabilizing solution should preferably be fed into the desalting chambers, and it is also preferable to feed it into the cathode chamber. The electrolyte solution to be fed into the concentration chambers and the anode chamber is not particularly limited, but there may preferably be employed a 0.1 to 2N solution of, for example, sodium sulfite, sodium sulfate, sodium chloride, potassium sulfate, sodium thiosulfate, etc. During this operation, it is very preferable to use the processing solution having fixing ability as the electrolyte solution to be fed into the concentration chambers and the anode chamber, because no other electrolyte solution is required. Also, silver can be recovered from the above electrolyte solution, and the electrolytic method or the ion-exchange resin method may be used as the method for recovery of silver.

The above ion-exchange resins may also be available from commercially sold products. For example, they are known under the names of Aciplex produced by Asahi Kasai Kogyo Co., Selemion produced by Asahi Glass Co., NEOSEPTA produced by Tokuyama Soda Co., Unilex produced by Mitsubishi Yuka Co., Nafion produced by Du Pont Co., etc.

As the materials for the electrodialytic cell and the respecive pipes, etc., there may be employed polyvinyl chloride, polypropylene, polyethylene, iron applied with rubber lining, etc. As the material for the cathode, iron, nickel, lead, zinc, titanium alloy, stainless steel, etc. may be employed. On the other hand, the anode may be made of a material such as platinum, platinum-plated titanium, graphite, lead peroxide, magnetite, etc.

In the reverse osmosis treatment of the above system [C], various kinds of reverse osmosis membranes, desalting-concentration methods and apparatus using reverse osmosis membranes can be utilized without any limitation. As the reverse osmosis membranes, cellulose acetate, aromatic polyamide, polyvinyl alcohol, poly sulfone are preferred. Particularly, cellulose acetate may preferably be employed The modules employing these reverse osmosis membranes include those produced by Toyo Boseki K.K., Toray K.K., Du Pont Co. and Paterson Oandy International Co., and the apparatus to be used for reverse osmosis treatment (hereinafter abbreviated as reverse osmotic apparatus) are manufactured and sold by Sasakura Kikai K.K., Kurita Kogyo K.K., Ebara Infirco K.K.

The reverse osmotic apparatus should be preferably operated under a pressure of 40 kg/cm$^2$ to 55 kg/cm$^2$ with respect to separating ability, treating ability, etc.

The activated charcoal (a) to be used in the above system [D] may be any activated charcoal having adsorption capacity. As the starting material for activated charcoal, any one of wood material, sawdust, coconut shell, ligning, cow bone, blood, lignite, brown coal, peat, coal, etc. may be available. The activated charcoal may be in the form of powder or granule, and either form may be used in this invention. For preparation of powdery activated charcoal, after the starting material is crushed, the crushed powder is activated by carbonization under high temperature, or sometimes activated by passing steam therethrough under high temperature, or alternatively dipped in a solution such as of zinc chloride, phosphoric acid, sulfuric acid or alkali prior to calcination and carbonization to effect activation. Otherwise, there is also the method in which the powder is activated by strong heating under reduced pressure or heating in air, carbon dioxide or chlorine gas to oxidize partially the charcoal. The activated product is usually washed for removal of ashes or chemicals, followed by crushing and drying to produce powdery activated charcoal. The granular activated charcoal is molded into certain particle sizes by binding powdery crushed charcoal with a binder such as tar or pitch, followed by drying, sintering and activation. When coconut shells or coals are to be employed, they are crushed, screened through a sieve before carbonization under high temperature for activation to give granular activated charcoal. In this invention, irrespectively of the starting material or the method for activitation to be employed, any powdery or granular activated charcoal can be used, preferably granular activated charcoal. Particularly, it is preferable to use coconut shell charcoal and an activated charcoal having molecular sieve ability. Here, the activated charcoal having molecular sieve ability refers to one having micropores in shape of slits, having pore length preferably of 6 Å or more and pore width preferably of 15 Å or less. As to the activated charcoal having such molecular sieve ability, reference may be made to the description in Japanese Unexamined Patent Publication No. 14831/1983 filed by the present Applicant.

The clay substance (b) to be used in the above system [D] is an inorganic substance containing silica and alumina as essential components together with other components if desired, including, for example, silicagel, bentonite, activated clay, acidic clay, kaoline, zeolite group such as zeolite, etc. Bentonite is a clay acid composed basically of hydrous aluminum silicate containing montmorillonite as the main ore. Activated clay is a clay substance containing montmorillonite and hallosite as the main ores. Acidic clay is also a similar clay substance. Kaoline is a clay substance comprising natural, hydrous aluminum silicate. The zeolite group such as zeolite, etc. is a clay substance which is a natural or synthetic zeolite having uniform micropore size, having molecular sieve action, etc. Other than zeolite, soda zeolite, chabazite, etc. may be also employed.

The polyamide type polymeric compound (c) to be used in the above system [D] refers to a polymer having an acid amide bonding such as 6-nylon, 6,6-nylon, 6,10-nylon, etc.

The polyurethane type polymeric compound (d) to be used in the above system [D] refers to a polymeric compound having a urethane bonding —NHCOO— in the recurring units of the main chain.

The phenol resin (e) to be used in the above system [D] refers to a resin obtained from a phenol such as phenol, cresol, xylenol, resorcin, etc. and an aldehyde such as formaldehyde, acetaldehyde, furfural, etc. or a modified resin thereof, preferably a phenol-formaldehyde resin, for example, Duorite S-761 resin, produced by Sumitomo Kagaku Kogyo Co.

The epoxy resin (f) to be used in the above system [D] refers to a polymeric compound containing epoxy groups.

The polymeric compound containing hydrazide group (g) to be used in the above system [D] refers to a polymeric compound in which, for example, a sulfohydrazide group, a carbonylhydrazide group or a hydrazide group is imparted to methyl acrylate-divinylbenzene copolymer, styrene-divinylbenzene copolymer, etc.

The polymeric compound containing polytetrafluoroethylene (h) to be used in the above system [D] refers to a mixture of polyethylene, polypropylene, polyvinyl chloride, etc. with polytetrafluoroethylene or a pure polytetrafluoroethylene, containing preferably 50% or more of polytetrafluoroethylene.

The monomethacrylate of monohydric or polyhydric alcohol which is a component of the monomethacrylate of monohydric or polyhydric alcohol-polymethacrylate of polyhydric alcohol copolymer (i) to be used in the above system [D] may be any methacrylate copolymer, preferably methyl methacrylate, ethyl methacrylate, propyl methacrylate, butyl methacrylate, 2-hydroxyethyl methacrylate, 2-hydroxypropyl methacrylate and the like. The polymethacrylate of polyhydric alcohol as the monomer for crosslinking may most preferably be ethyleneglycol dimethacrylate, and polyethylene glycol (n is 1 to 10) dimethacrylate such as diethylene glycol dimethacrylate, triethylene glycol dimethacrylate, etc. are also preferred. Further, trimethylolpropane trimethacrylate, pentaerythritol tetramethacrylate, etc. can also be used. The copolymer may preferably be porous and a porous methacrylate copolymer with a composition containing 10 to 90 5 by weight of a monohyric or polyhydric alcohol monomethacrylate may be used. Above all, one containing 50% or less of a polymethacrylate polyhydric alcohol is preferred. More specifically, Amberlite XAD-7, 8 and 9 produced by Rohm & Haas are preferred.

These substanece to be used in the above system [D] should preferably be porous, having a large surface state, preferably with a range of specific surface area from about 1 to 3000 $m^2/g$, more preferably from 100 to 1000 $m^2/g$. The micropore radius may preferably be 4 to 2000 Å.

Among the substances to be used in the above system [D], particularly preferred are (a) activated charcoal, (b) clay substance, (e) phenol resin and (i) monohydric or polyhydric alcohol mono methacrylate-polyhydric alcohol polymethacrylate copolymer.

In this invention, as the aforesaid concentration regulating treatment method, the respective treatment methods of the above [A] to [D] may be individually employed or they can be employed in any desired combination. Further, as the pre-treatment or the post-treatment method, it is possible to employ the agglomerating precipitation method, the agglomerating precipitation method and filtration method (any filter material may be available), the biological treatment method (aeration type activated sludge method, rotating disc method, fixed-bed type catalytic oxidation method, etc.), etc.

Further, in place of the above treatment method, the agglomerating precipitation method or the filtration method may be employed, or otherwise it is also possible to employ the ultrafiltration membrane treatment together with the above treatment methods.

As to the above concentration regulating treatment, reference may be made to the techniques as disclosed in Japanese Unexamined Patent Publication No. 220345/1985 and Japanese Patent Applications Nos. 96350/1984, 96352/1984 and 119153/1984.

As the particularly desirable compounds to be added into the water washing-substitutive stabilizing solution, there may be included the fungicides as set forth below.

The antifungal agent to be preferably used in this invention may include hydroxybenzoic acid compounds, alkylphenolic compounds, thiazole compounds, pyridinium compounds, guanidine compounds, carbamate compounds, morpholine compounds, quaternary phosphonium compounds, ammonium compounds, urea compounds, isoxazole compounds, propanolamine compounds and amino acid compounds.

The aforesaid hydroxybenzoic acid compounds may include p-hydroxybenzoic acid, methyl ester, ethyl ester, propyl ester and butyl ester of p-hydroxybenzoic acid, etc., preferably p-hydroxybenzoic acid or n-butyl ester, isobutyl ester or propyl ester of hydroxybenzoic acid.

The alkylphenyl compounds are compounds with the alkyl group having $C_1$ to $C_6$ alkyl groups as substituents, preferably o-phenylphenol, o-cyclohexyphenol.

The thiazole compounds are compounds having nitrogen atom and sulfur atom in the five-membered ring, preferably 1,2-benzisothiazoline-3-one, 2-methyl-4-isothiazoline-3-one, 2-octyl-4-isothiazoline-3-one, 5-chloro-2-methyl-4-isothiazoline-3-one, 2-14-thiazolyln The pyridinium compounds may include 2,6-dimethylpyridine, 2,4,6-trimethylpyridine, sodium-2-pyridinethiol 1-oxide, etc., preferably sodium-2-pyridinethiol-1-oxide.

The guanidine compounds may specifically include cyclohexidine, polyhexamethylene biguanidine hydrochloride, dodecylguanidine hydrochloride, preferably dodecylguanidine and its salts.

The carbamate compounds may specifically include methyl-1-(butylcarbamoyl)-2-benzimidazole carbamate, methylimidazole carbamate and the like.

The morpholine compounds may specifically include 4-(2-nitrobutyl)morpholine, 4-(3-nitrobutyl)morpholine and the like.

The quaternary phosphonium compounds may include tetraalkylphosphonium salts, tetraalkoxyphosphonium salts and the like, preferably tetraalkylphosphonium salts. More specifically, tri-n-butyl-tetradecylphosphonium chloride, tri-phenylnitrophenylphosphonium chloride are preferred.

Specific examples of the quaternary ammonium compounds asre benzalconium salts, benzethonium salts, tetraalkylammonium salts, alklylpyridinium salts, etc., more specifically dodecyldimethylbenzylammonium chloride, didecyldimethylammonium chloride, laurylpyridinium chloride, etc.

The urea compounds may specifically include N-(3,4-dichlorophenyl)-N'-(4-chlorophenyl)urea, N-(3-trifluoromethyl-4-chlorophenyl)-N'-(4-chlorophenyl)urea and th like.

The isoxazole compounds may typically be 3-hydroxy-5-methyl-isoxazole and the like.

The propanolamine compounds are inclusive of an n-propanol and an isopropanol, specifically DL-2-benzylamino-1-propanol, 3-diethylamino-l-propanol, 3-diethylamino-1-propanol, 2-dimethylamino-2-methyl-l-propanol, 3-amino-1-propanol, isopropanolamine, diisopropanolamine, N,N-dimethyl-isopropanolamine and the like.

The amino acid compounds may typically be N-lauryl-$\beta$-alanine.

Of the above antifungal agents, those which can preferably be used in this invention are thiazole compounds, pyridinium compounds, quanidine compounds, and quaternary ammonium compounds. Further, thiazole compounds are particularly preferred.

In this invention, the water washing-substitutive stabilizing solution should preferably contain a sulfurous acid salt. The sulfurous acid salt may be either organic or inorganic, so long as it can release sulfurous acid ions, preferably an inorganic salt. Preferable specific compounds may include sodium sulfite, potassium sulfite, ammonium sulfite, potassium bisulfite, sodium bisulfite, sodium metabisulfite, potassium metabisulfite, ammonium metabisulfite and hydrosulfite.

The above sulfurous acid salt is added in the stabilizing solution in an amount of at least $1\times10^{-3}$ mole/liter, preferably $5\times10^{-}$'mole/liter to $10^{-1}$ mole/liter. Although it can be added directly to the stabilzing solution, it should preferably be added to the stabilizing supplemental solution of the water washing-substitutive stabilizing solution.

Ammonium compounds are other desirable compounds to be added to the water washing-substitutive stabilizing solution.

These are supplied by ammonium salts of various inorganic compounds, includincg specifically ammonium hydroxide, ammonium bromide, ammonium carbonate, ammonium chloride, ammonium hypophosphite, ammonium phosphate, ammonium phosphite, ammonium fluoroborate, ammonium arsenate, ammonium hydrogen carbonate, ammonium hydrofluoride, ammonium hydrogen sulfate, ammonium sulfate, ammonium iodide, ammonium nitrate, ammonium pentaborate, ammonium acetate, ammonium adipate, ammonium laurintricarboxylate, ammonium benzoate, ammonium carbamate, ammonium citrate, ammonium diethyldithiocarbamate, ammonium formate, ammonium hydrogen malate, ammonium hydrogen oxalate, ammonium hydrogen phthalate, ammonium hydrogen tartarate, ammonium thiosulfate, ammonium sulfite, ammonium ethylenediaminetetraacetate, ferric ammonium ethylenediaminetetraacetate, ammonium lactate, ammonium malate, ammonium maleate, ammonium oxalate, ammonium phthalate, ammonium picrate, ammonium pyrrolidinedithiocarbamate, ammonium salicylate, ammonium succinate, ammonium sulfanylate, ammonium tartarate, ammonium thioglycolate, 2,4,6-tri-nitrophenolammonium, etc. These can be used either singly or as a combination of two or more compounds.

The ammonium compound may be added in an amount in the range of from 0.001 to 1.0 mole, preferably from 0.002 to 0.2 mole, per liter of the stabilizing solution.

In this invention, the pH of the water washing-substitutive stabilizing solution should preferably be within the range of from 3.0 to 9.5, more preferably adjusted at pH 3.5 to 9.0 for the objects of this invention. Further, in this invention, the water washing-substitutive stabilizing solution should preferably contain a chelating agent with a chelate stability constant for iron ions of 8 or more for the objects of this invention.

The chelate stability constant as mentioned herein means the constant generally known as from L. G. Sillen, A. E. Martell "Stability Constants of Metali-ion Complexes", The Chemical Society, London (1964); S. Chaberek, A. E. Martell "Organic Sequestering Agents", Wiley (1959), etc.

As the chelating agents or organic phosphoric acid chelating agents with chelating stability constant of 8 or more for iron ions, there may be included organic carboxylic acid chelating agents, organic phosphoric acid chelating agents, inorganic phosphoric acid chelating agents, polyhydroxy compounds, etc. Here, the above iron ions mean ferric ions ($Fe^{3+}$).

Specific exemplary compounds of the chelating agents with chelate stability constant for ferric ions of 8 or more include the following compounds, but this invention is not limited thereto. That is, preferable compounds are ethylenediamine-di-o-hydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, trans-cyclohexanediaminetetraacetic acid, glycoletherdiaminetetraacetic acid, ethylenediamine tetrakismethylenephosphonic acid, nitrilotrimethylenehosphonic acid, 1-hydroxyethylidene-1,1'-diphosphonic acid, 1,1-diphosphonoethane-2-carboxylic acid, 2-phosphonobutane-1,2,4-tricarboxylic acid, 1-hydroxy-1 -phosphonopropane-1,2,3-tricarboxylic acid catechol-3 acid, sodium pyrophosphate, sodium tetrapolyhosphate, sodium hexametaphosphate and the like, particularly preferably diethylenetriaminepentaacetic acid, nitrilotriacetic acid, 1-hydroxyethylidene-1,1-diphosphonic acid or salts thereof.

The above chelating agent may be used in an amount of 0.01 to 50 g, preferably 0.05 to 20 g, per liter of the water washing-substitutive stabilizing solution, to give favorable results Other compounds to be added to the water washing-substitutive stabilizing solution than those as mentioned above may include droplet irregularity preventives such as metal salts of B, Mg, Zn, Ni, Al, Sn, Ta, Zr, etc., polyvinyl pyrrolidone (trade name: PVP K-15, K-30, K-90; produced by BASF), fluorescent whitening agents, organic sulfur compounds, onium salts, film hardeners, quaternary salts, polyethylene oxide derivatives, cycloxane derivatives, etc.; pH controllers such as boric acid, citric acid, phosphoric acid, acetic acid, sodium hydroxide, sodium acetate, potassium citrate; organic solvents such as methanol, ethanol, dimethyl sulfoxide; dispersing agents such as ethylene glycol, polyethylene glycol; other various additives for improving or expanding the treatment effects as desired.

Feeding of the water washing-substitutive stabilizing solution in the stabilizing processing step according to this invention, when practiced according to the multi-tank countercurrent system, should be preferably carried out by feeding the solution to the later bath, while permitting the solution to be overflowed from the earlier bath. Of course, processing in a single bath may be possible. On the other hand, the above compounds may be added as concentrated solutions into the stabilizing tank, or alternatively the above compounds and other additives may be added to the water washing-substitutive stabilizing solution to be fed into the stabilizing tank to provide the resultant mixture as a replenishing solution for the water washing-substitutive stabilizing solution. Further, it is also possible to incorporate these in the light-sensitive material to be processed in the earlier bath, thereby permitting them to exist in the stabilizing bath. Any one of such various addition methods may be employed.

Stabilizing processing may be carried out at a temperature ranging from 15° C. to 60° C., preferably from 20° C. to 45° C. The processing time should also preferably be as short as possible from the viewpoint of rapid processing, but usually from 20 seconds to 10 minutes, most preferably from one minute to 5 minutes, with the processing time being preferably shorter for the tanks of earlier stages while longer for the tanks of later stages.

The lignt-sensitive material of this invention should preferably contain a cyan coupler of the formula [III] or [IV] shown below for storage stability of cyan dyes in dark places:

Formula [III]

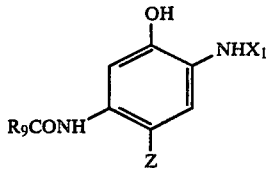

Formula [IV]

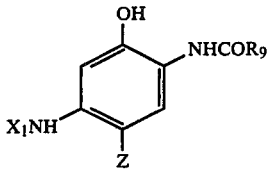

In the above formulae, $X_1$ represents

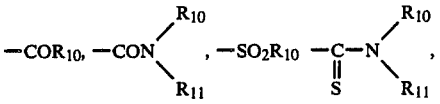

-continued

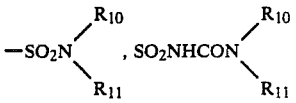

$-CONHCOR_{10}$ or $-CONHSO_2R_{10}$ ($R_{10}$ is an alkyl group, an alkenyl group, a cycloalkyl group, an aryl group or a hetero ring; $R_{11}$ is a hydrogen atom, an alkyl group, an alkenyl group, a cycloalkyl group, an aryl group or a hetero ring; or $R_{10}$ and $R_{11}$ may be bonded to each other to form a 5- to 6-membered ring), $R_9$ represents a ballast group, Z represents a hydrogen atom or a group eliminable through coupling with the oxidized product of an aromatic primary amine color developing agent.

In the following, specific examples of the cyan coupler represented by the above formulae [III] and [IV] are enumerated.

[Exemplary compound]

(1)

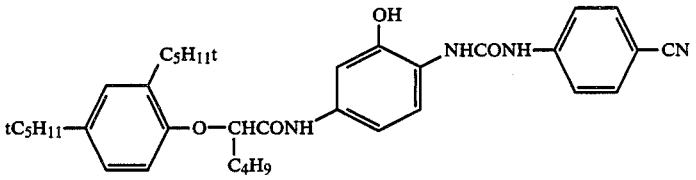

(2)

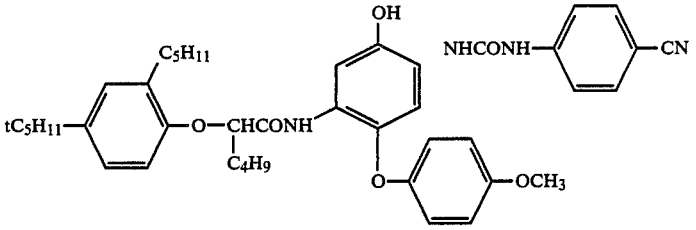

(3)

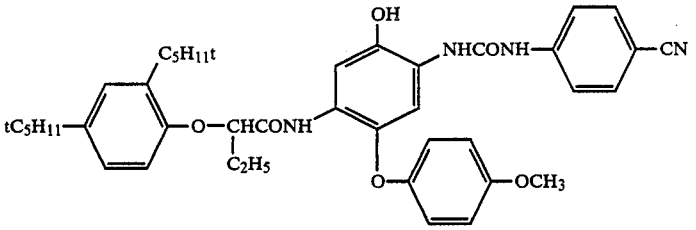

(4)

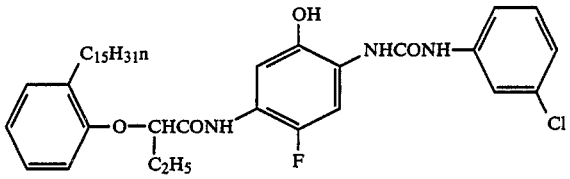

-continued
[Exemplary compound]
(5)
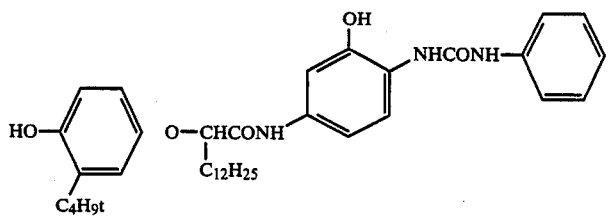
(6)
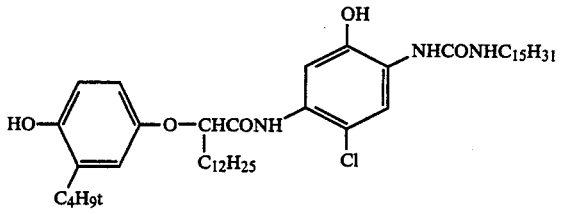
(7)
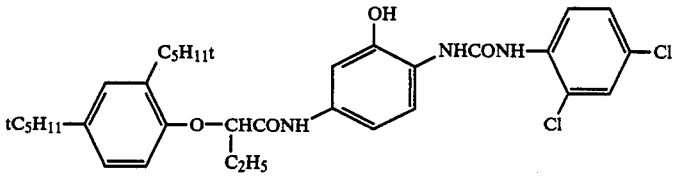
(8)
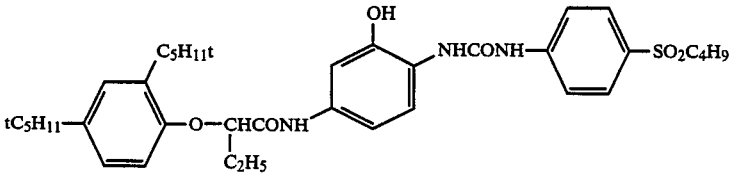
(9)
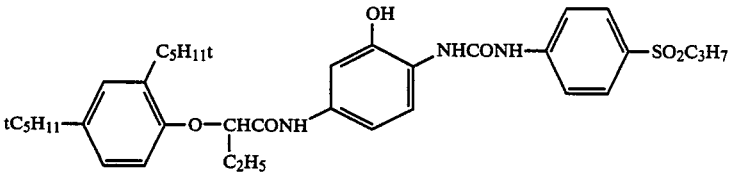
(10)
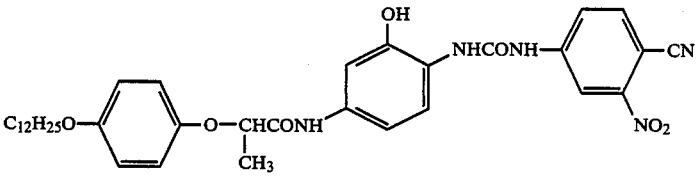
(11)
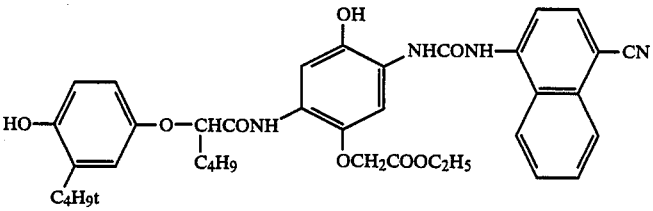

-continued
[Exemplary compound]
(12)
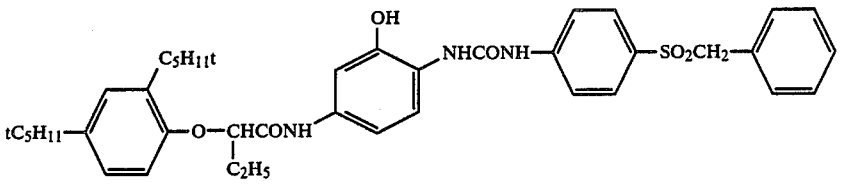
(13)
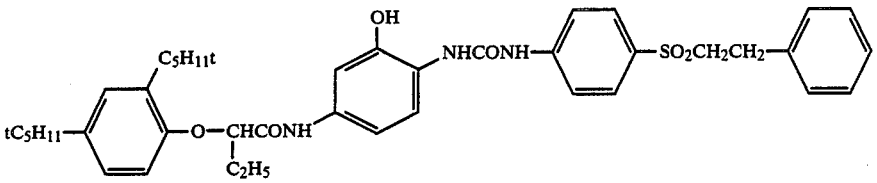
(14)
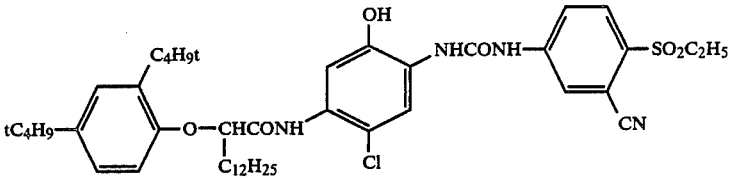
(15)
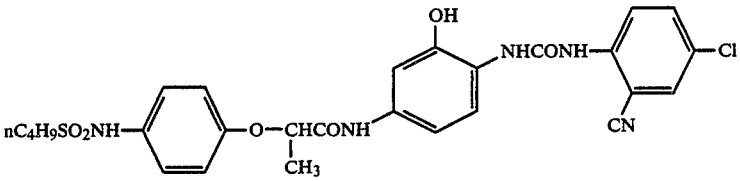
(16)
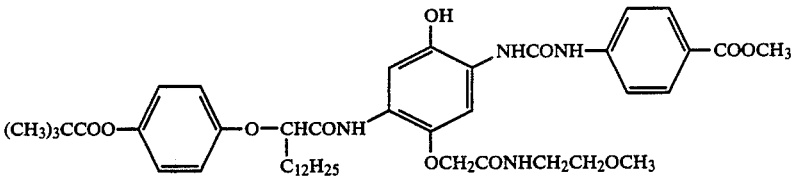
(17)
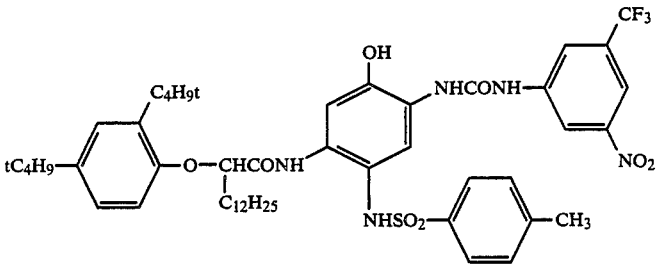
(18)
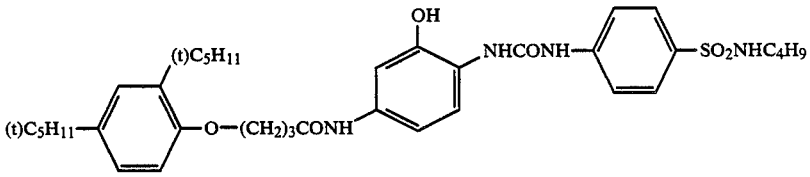

-continued
[Exemplary compound]
(19)
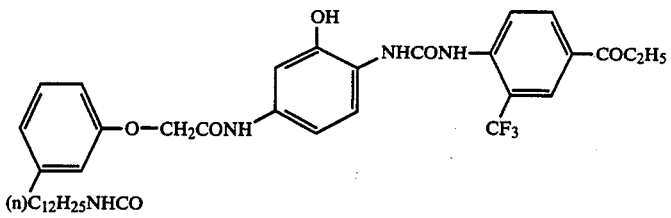
(20)
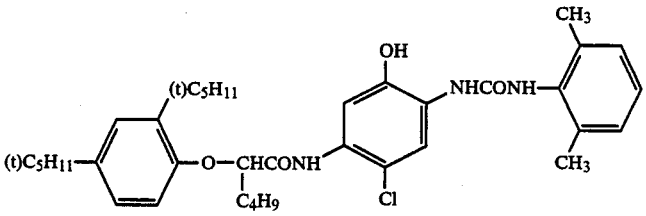
(21)
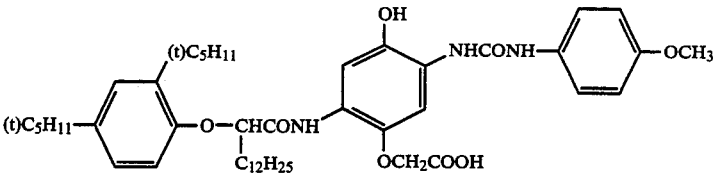
(22)
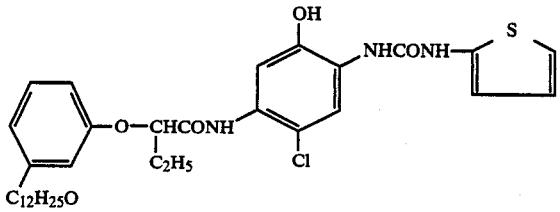
(23)
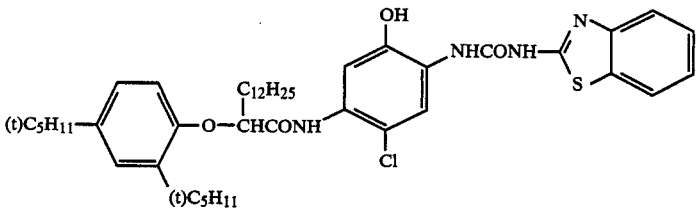
(24)
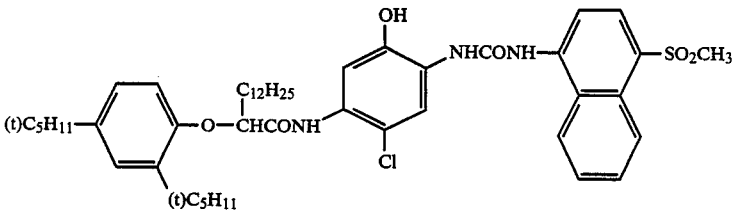
(25)
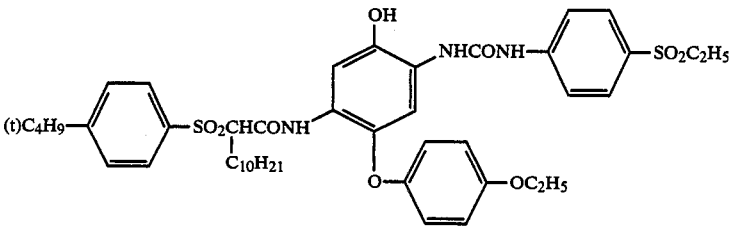

-continued
[Exemplary compound]
(26)
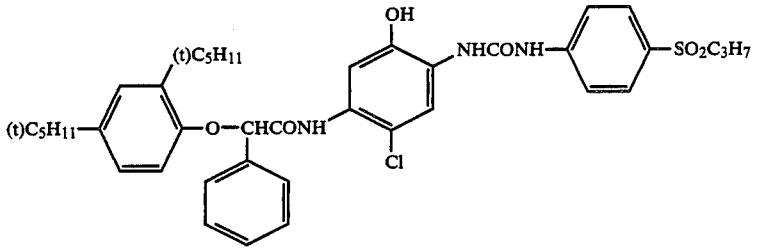
(27)
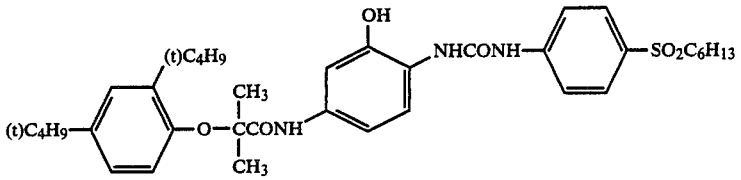
(28)
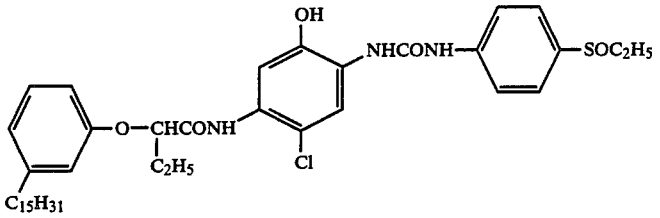
(29)
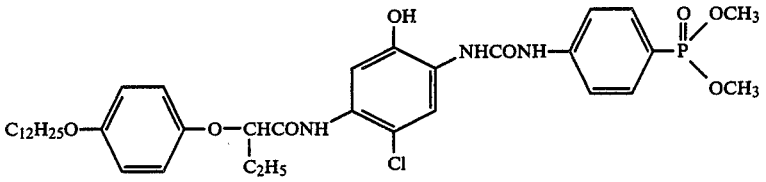
(30)
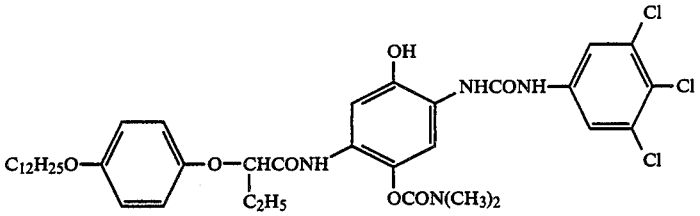
(31)
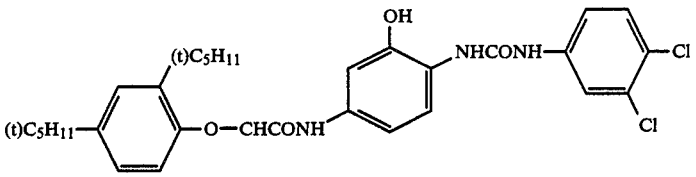
(32)
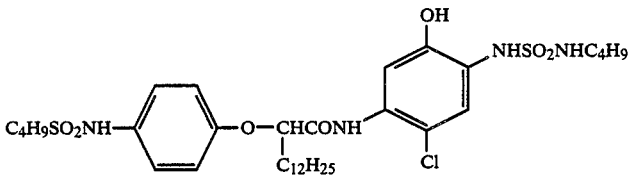

-continued
[Exemplary compound]
(33)
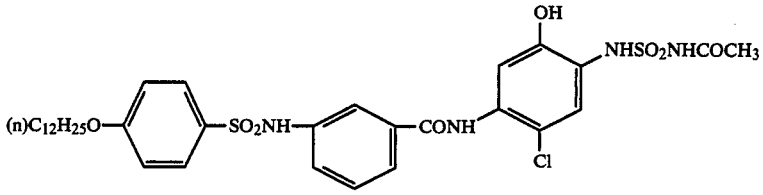
(34)
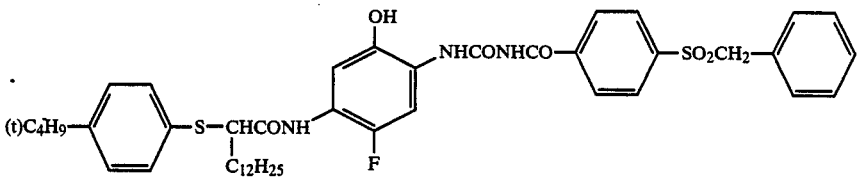
(35)
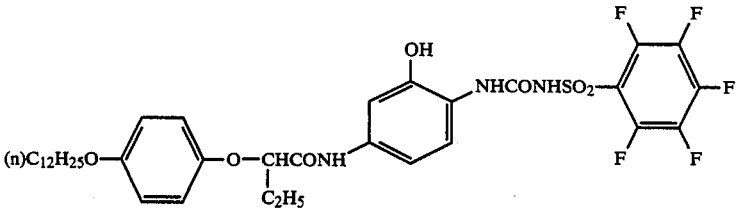
(36)
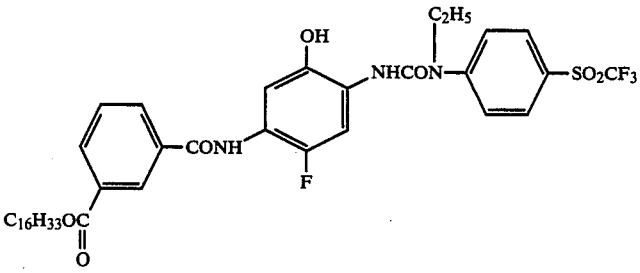
(37)
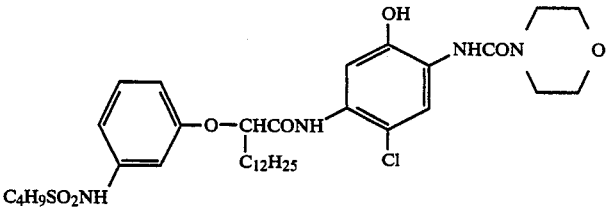
(38)
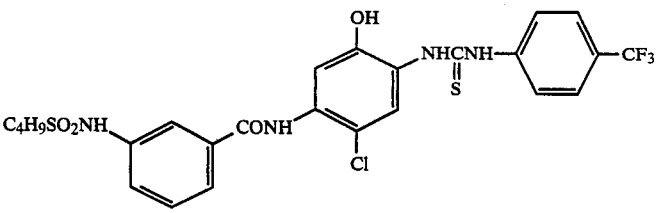
(39)
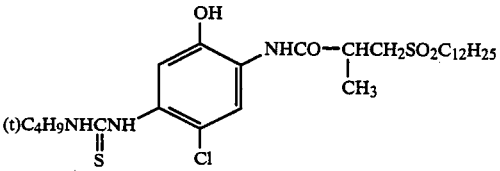

-continued
[Exemplary compound]
(40)
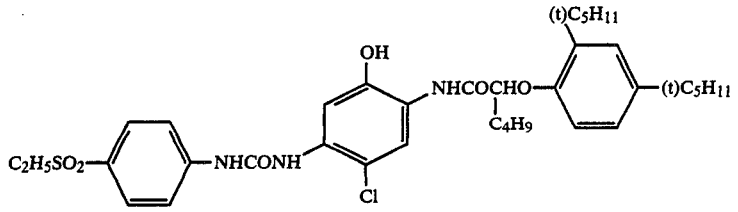
(41)
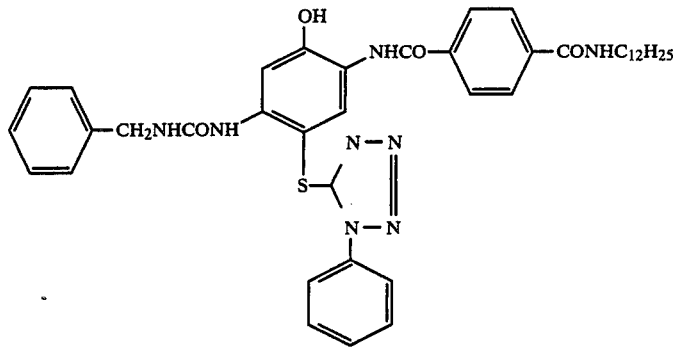
(42)
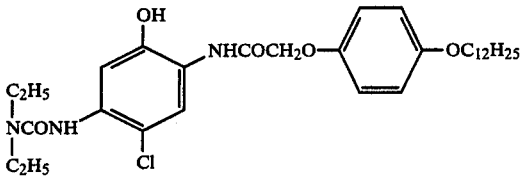
(43)
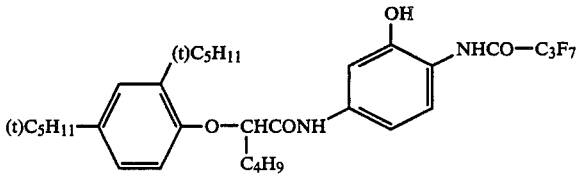
(44)
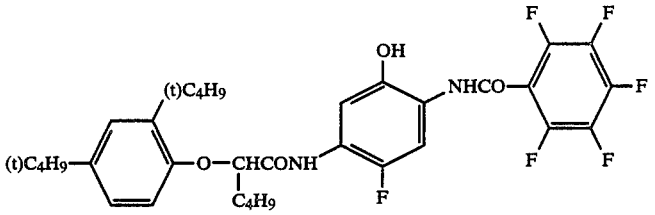
(45)
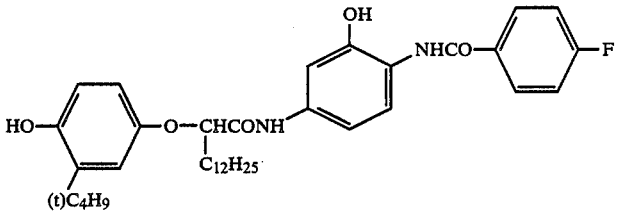
(46)
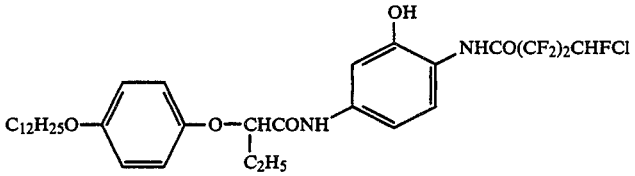

-continued
[Exemplary compound]
(47)
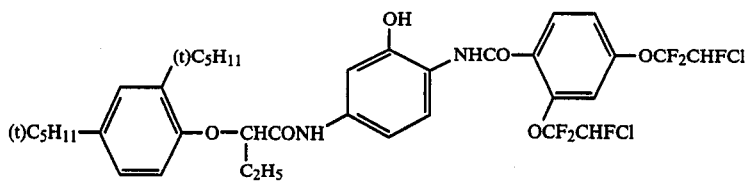
(48)
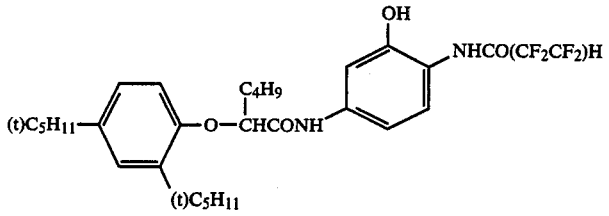
(49)
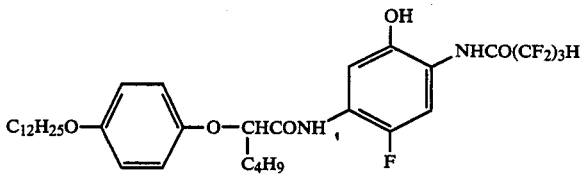
(50)
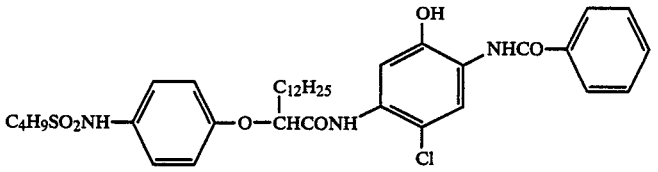
(51)
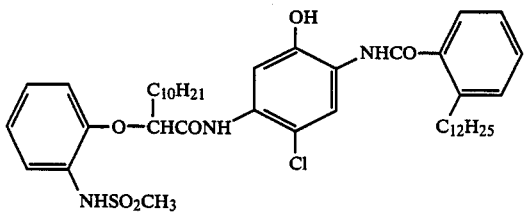
(52)
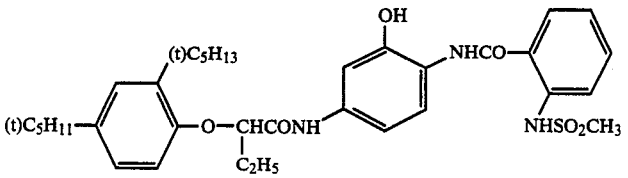
(53)
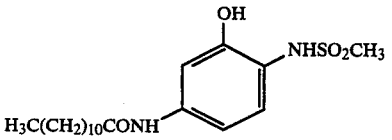
(54)
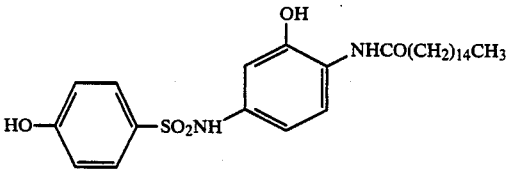

-continued
[Exemplary compound]
(55)
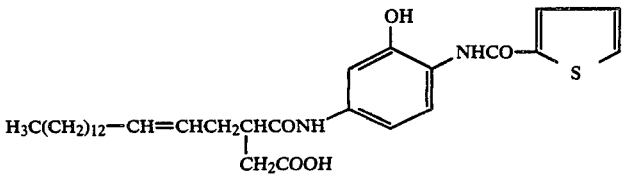
(56)
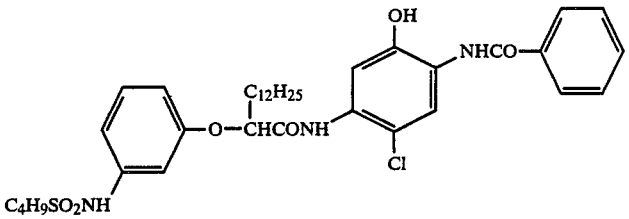
(57)
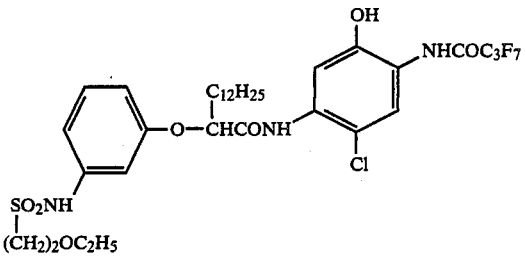
(58)
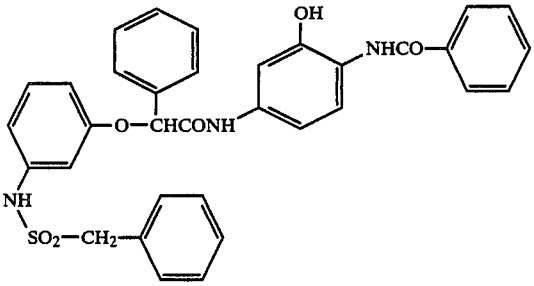
(59)
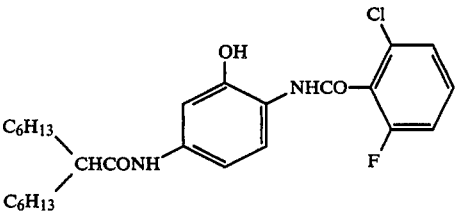
(60)
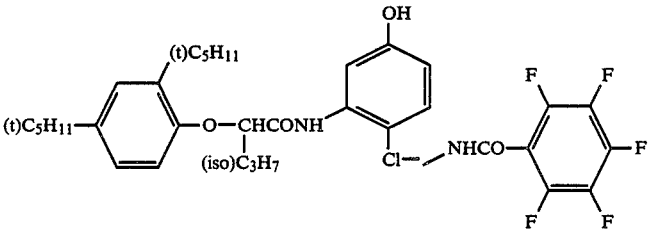

-continued
[Exemplary compound]
(61)
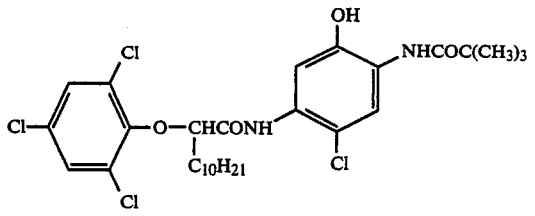
(62)
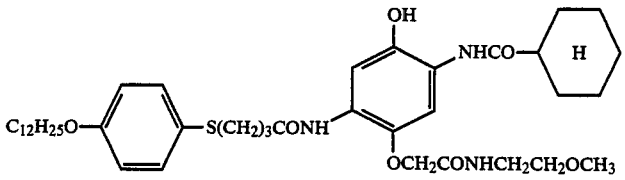
(63)
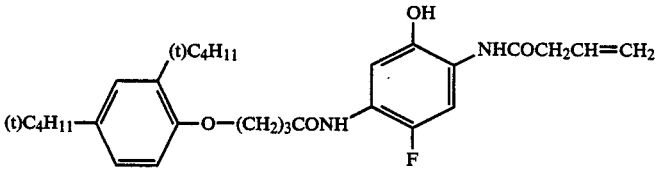
(64)
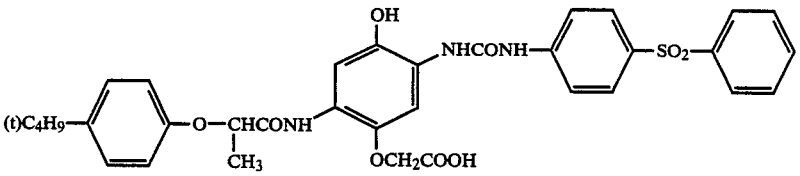
(65)
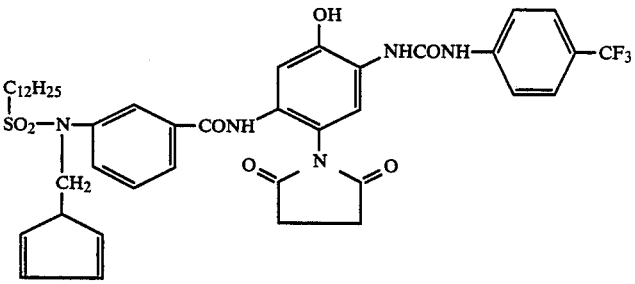
(66)
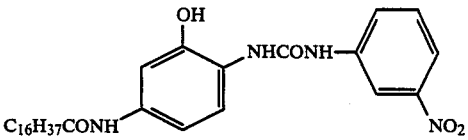
(67)
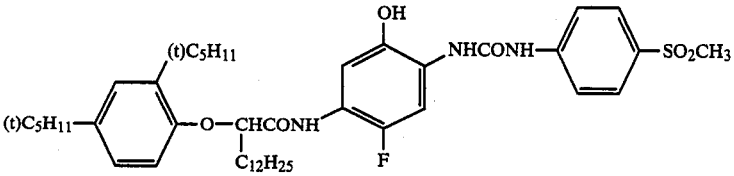

-continued

[Exemplary compound]

(68)

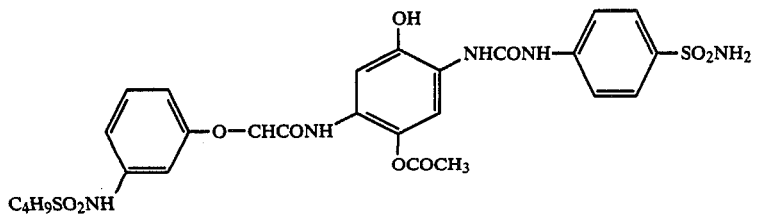

(69)

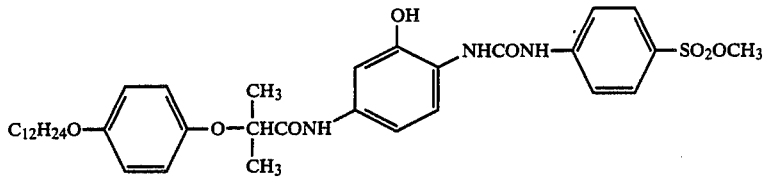

(70)

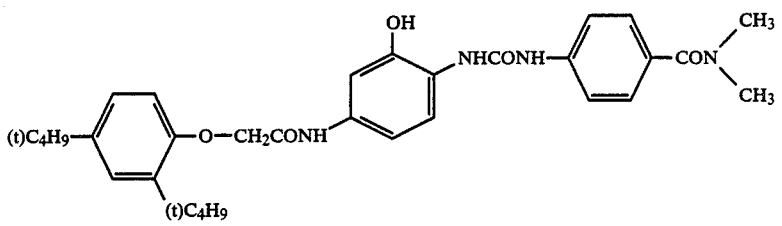

(71)

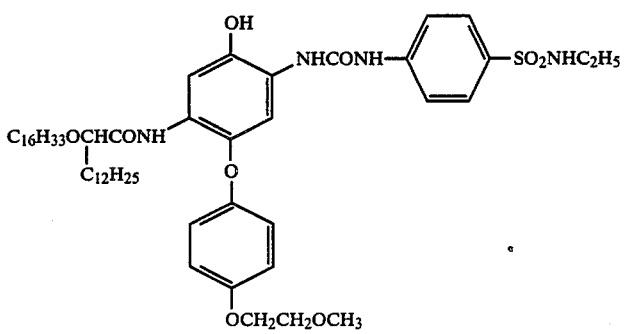

(72)

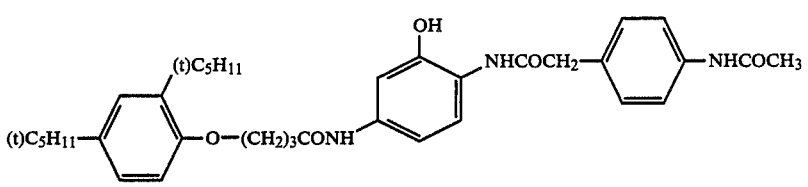

These cyan couplers can be synthesized by methods known in the prior art disclosed in, such as U.S. Pat. Nos. 2,772,162, 3,222,176, 3,758,308, 3,880,661 and 4,124,396, U.K. Pat. No. 975,773, Japanese Unexamined Pat. Publications Nos. 21139/1972, 112038/1975, 134644/1975, 69329/1977, 99341/1980, 163537/1980, 29235/1981, 55945/1981, 80045/1981 and 116030/1981, as well as U.K. Pat. No. 1,011,940, U.S. Pat. Nos. 3,446,622 and 3,996,253, Japanese Unexamined Patent Publications Nos. 65134/1981, 204543/1982, 204544/1982 and 204545/1982 and Japanese Patent Applications Nos. 130459/1981, 131309/1981, 131311/1981, 131312/1981, 131313/1981, 131314/1981 and 149791/1982, and so on.

Furthermore, in the above formulae [I] to [II''], alkyl groups and aryl groups of $R_6$ to $R_{44}$ preferably have carbonyl groups or sulfo groups as substituents.

Examples of the cyan couplers and others to be preferably used in the light-sensitive material of this invention may include the exemplary compounds as disclosed in Japanese Patent Application No. 7903/1983 filed by the present Applicant.

Further, in the light-sensitive material of this invention it is most preferred for storage stability in dark places to use a cyan coupler represented by the formula [V] shown below:

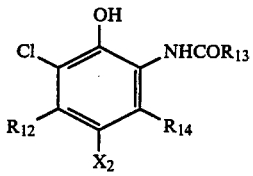

Wherein, one of $R_{12}$ and $R_{14}$ is hydrogen, the other represents a straight or branched alkyl group having 2 to 12 carbon atoms, $X_2$ represents a hydrogen atom or a group eliminable through coupling reaction, and $R_{13}$ represents a ballast group.

In the following, specific exemplary compounds of the cyan coupler represented by the above formula [V] are shown. Other exemplary compounds than those shown in the Table below include exemplary compounds (7) to (23) disclosed in Japanese Patent Application No. 95613/1984 filed by the present Applicant.

(Exemplary compound)

| Coupler No. | $R_{12}$ | $X_2$ | $R_{13}$ | $R_{14}$ |
|---|---|---|---|---|
| (73) | $-C_2H_5$ | $-Cl$ | 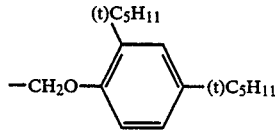 | $-H$ |
| (74) | $-C_2H_5$ | 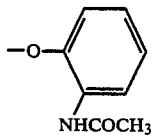 | 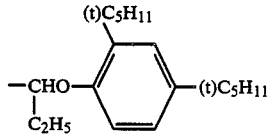 | $-H$ |
| (75) | 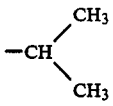 | $-Cl$ | 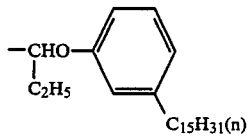 | $-H$ |
| (76) | $-C_2H_5$ | $-Cl$ | 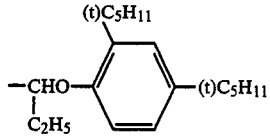 | $-H$ |
| (77) | $-C_2H_5$ | $-Cl$ | 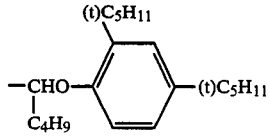 | $-H$ |
| (78) | $-C_4H_9$ | $-F$ | 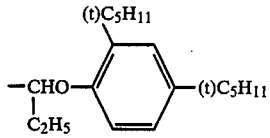 | $-H$ |
| (79) | $-C_2H_5$ | $-Cl$ | 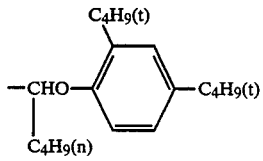 | $-H$ |
| (80) | $-C_2H_5$ | $-H$ | 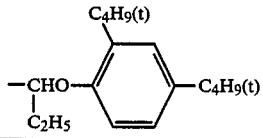 | $-H$ |

The silver halide emulsion which can be used in this invention may employ any of silver halide such as silver chloride, silver bromide, silver iodide, silver chlorobromide, silver chloroiodide, silver iodobromide, silver chloroiodobromide, etc. As the protective colloid for these silver halide, in addition to natural products such as gelatin, various synthetic products may be used. The silver halide emulsion may also contain conventional additives for photography such as stabilizers, sensitizers, film hardeners, sensitizing dyes, surfactants, etc.

The support may be any material such as polyethylene-coated paper, triacetate film, polyethyleneterephthalate film, white polyethyleneterephthalate film, etc.

The aromatic primary amine color developing agent to be used in the color developing solution for the light-sensitive material of this invention may include known compounds which are widely used in various color photographic processes. These developing agents include aminophenol type and p-phenylenediamine type derivatives. These compounds may be used in the form of salts, for example, hydrochlorides or sulfates, because of they are more stable than free form. Also, these compounds may be used generally in an amount of about 0.1 g to about 30 g per liter of color developing solution, preferably about 1 g to about 1.5 g per liter of the color developing solution.

The aminophenol type developer may include, for example, o-aminophenol, p-aminophenol, 5-amino-2-oxytoluene, 2-amino-3-oxytoluene, 2-oxy-3-amino-1,4-dimethylbenzene and the like.

Particularly useful primary aromatic amino type color developers are N,N'-dialkyl-p-phenylenediamine type compounds, in which the alkyl group and the phenyl group may be substituted with any desired substituent. Among them, examples of particularly useful compounds are N,N'-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-β-methanesulfonamidoethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluenesulfonate, etc.

The color developing solution can further contain, in addition to the above primary aromatic amine type color developer, various components conventionally added in color developing solutions, including alkali agents such as sodium hydroxide, sodium carbonate, potassium carbonate, etc.; alkali metal sulfites; alkali metal bisulfites; alkali metal thiocyanates; alkali metal halides; benzyl alcohol; water softeners and thickening agents, etc., as desired. The pH value of the color developing solution is usually 7 or higher, most generally about 10 to about 13.

The fixing solution to be used in this invention may contain as the fixing agent, for example, thiosulfates (disclosed in Japanese Unexamined Patent Publication No. 185435/1982), thiocyanates (disclosed in U.K. Pat. No. 565135, Japanese Unexamined Patent Publication No. 137143/1979), halides (disclosed in Japanese Unexamined Patent Publication No. 130639/1977), thioethers (disclosed in Belgian Pat. No. 626,970), thioureas (disclosed in U.K. Pat. No. 1,189,416), etc. Among these fixing agents, those on which the effect of this invention can effectively act are only thiosulfates. Also, when the processing solution having fixing ability is a bleach-fixing solution, organic ferric complexes may be available as the bleaching agent (disclosed in Japanese Patent Publication No. 38895/1979, Japanese Unexamined International Patent Publication (TOKUHYOSHO) No. 500704/1980, Japanese Unexamined Patent Publications Nos. 52748/1981 and 149358/1984).

Further, when the processing solution having fixing ability according to this invention is a processing solution intended to fixing processing and bleaching step is conducted as the step prior thereto, any bleaching agent may be available, including red prussiate, iron chloride (disclosed in U.K. Pat. No. 736881, Japanese Patent Publication No. 44424/1981), persulfate (disclosed in German Pat. No. 21 41 199), hydrogen peroxide (disclosed in Japanese Patent Publication Nos. 11617/1983, 11618/1983), organic acid ferric complexes (disclosed in Japanese Unexamined Patent Publication Nos. 70533/1982, 43454/1983 and 166957/1984.

In the processing of this invention, silver may be recovered according to the known method from the water washing-substitutive stabilizing solution, as a matter of course, and also from the processing solutions containing soluble silver complexes such as fixing solution and bleach-fixing solution. For example, it is possible to utilize effectively the electrodialytic method (disclosed in French Pat. No. 2,299,667), the precipitation method (disclosed in Japanese Unexamined Patent Publication No. 73037/1977, German Pat. No. 23 31 220), the ion-exchange method (disclosed in Japanese Unexamined Patent Publication No. 17114/1976, German Pat. No. 25 48 237) and the metal substitution method (disclosed in U.K. Pat. No. 1,353,805).

The processing method of this invention may be used for processing of color negative paper, color positive paper, reversal color paper, color positive film, color negative film, color reversal film, color X-ray film, etc.

This invention is described in detail below by referring to the following Examples, by which the embodiments of this invention are not limited at all.

EXAMPLE 1

The experiments were conducted by use of the color paper, the processing solution and the processing steps as described below.

[Color paper]

A polyethylene-coated paper support was coated successively from the support side with the respective layers as shown below to prepare a light-sensitive material.

The polyethylene-coated paper employed was prepared by forming a coating layer with a thickness of 0.035 mm on the surface of a fine paper with a weight of 170 g/m$^2$ by extrusion coating method of a mixture of 200 parts by weight of a polyethylene having an average molecular weight of 100,000 and a density of 0.95 and 20 parts of a polyethylene having an average molecular weight of 2,000 and a density of 0.80 to which 6.8 % by weight of an anatase type titanium oxide was added and providing a coating layer with a thickness of 0.040 mm consisting only of a polyethylene on the back of the paper. After pre-treatment with corona discharging was applied on the polyethylene-coated surface of the support, the respective layers were successively coated thereon.

First layer

A blue-sensitive silver halide emulsion layer comprising a silver chlorobromide emulsion containing 95 mole % of silver bromide, said emulsion containing 350 g of gelatin per 1 mole of silver halide, being sensitized with $2.5\times10^{-4}$ mole of a sensitizing dye (with the use of isopropyl alcohol as the solvent) having the structural formula shown below per mole of the silver halide:

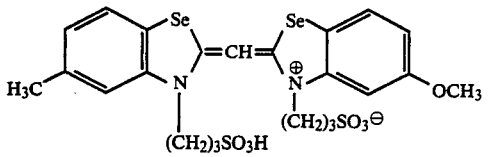

containing 2,5-di-t-butylhydroquinone dispersed as a solution in dibutylphthalate and $2\times10^{-1}$ mole per mole of the silver halide of α-[4-(1-benzyl-2-phenyl-3,5-dioxo-1,2,4-triazolidyl)]-α-pivalyl-2-chloro-5-[γ-(2,4-di-t-amylphenoxy)butylamido]acetanilide as the yellow coupler, which is applied so as to a silver quantity is 330 mg/m².

Second layer

A gelatin layer containing 300 mg/m² of di-t-octylhydroquinone dispersed as a solution in dibutylphthalate, 200 mg/m² of a mixture of 2-(2'-hydroxy-3',5-di-t-butylphenyl)benzotriazole, 2-(2'-hydroxy-5'-t-butylphenyl)-benzotriazole, 2-(2'-hydroxy-3'-t-butyl-5'-methylphenyl)-5-chlorobenzotriazole and 2-(2'-hydroxy-3',5'-di-t-butylphenyl)-5-chloro-benzotriazole as the UV-ray absorber, which is applied so as to a gelatin content is 2000 mg/m².

Third layer

A green-sensitive silver halide emulsion layer comprising a silver chlorobromide emulsion containing 85 mole % of silver bromide, said emulsion containing 450 g of gelatin per mole of the silver halide, being sensitized with $2.5\times10^{-4}$ mole of a sensitizing dye having the structural formula shown below per mole of the silver halide:

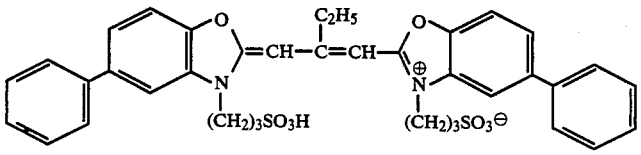

containing 2,5-di-t-butylhydroquinone dissolved in a solvent comprising dibutylphthalate and tricresyl phosphate (2:1) and $1.5\times10^{-1}$ mole per mole of the silver halide of 1-(2,4,6-trichlorophenyl)-3-(2-chloro-5-octadecenylsuccinimidoanilino)-5-pyrazolone as the magenta coupler, which is applied so as to a silver quantity is 300 mg/m². As the antioxidant, 0.3 mole of 2,2,4-tri-methyl-6-lauryloxy-7-t-octylcoumarone was used per mole of the coupler.

Fourth layer

A gelatin layer containing 30 mg/m² of di-t-octylhydroquinone dispersed as a solution in dibutylphthalate, 500 mg/m² of a mixture of 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chlorobenzotriazole and 2-(2'-hydroxy3',5'-t-butylphenyl)-5-chloro-benzotriazole (2:1.5:1.5:2) as the UV-ray absorber, which is applied so as to a gelatin content is 2000 mg/m².

Fifth layer

A red-sensitive silver halide emulsion layer comprising a silver chlorobromide emulsion containing 85 mole % of silver bromide, said emulsion containing 500 g of gelatin per mole of the silver halide, being sensitized with $2.5\times10^{-4}$ mole of a sensitizing dye having the structural formula shown below per mole of the silver halide:

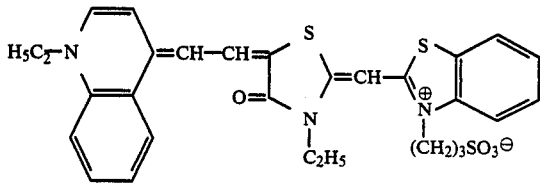

containing 2,5-di-t-butylhydroquinone dispersed as a solution in dibutylphthalate and $3.5\times10^{-1}$ mole per mole of the silver halide of an equimolar mixture of the Exemplary cyan coupler (21) and 2,4-dichloro-3-methyl-6-[γ-(2,4-diamylphenoxy)butylamido]phenol as the cyan coupler, which is applied so as to a silver quantity is 300 mg/m².

Sixth layer

A gelatin layer applied so as to a gelatin content is 1,000 mg/m².

The silver halide emulsions used in the respective light-sensitive emulsion layers (the first, third and fifth layers) were prepared according to the method as described in Japanese Patent Publication No. 7772/1971, each being chemically sensitized with the use of sodium thiosulfate pentahydrate, and 4-hydroxy-6-methyl-1,3,3a,7-tetrazaindene as the stabilizer, bis(vinylsulfonylmethyl)ether as the film hardener and saponin as the coating aid were incorporated in each emulsion.

[Processing steps]

| | | |
|---|---|---|
| [1] Color developing | 38° C. | 3 min. |
| [2] Bleach-fixing | 33° C. | 1 min. |
| [3] Stabilizing processing | 25 to 30° C. | 2 min. |
| [4] Drying | 75 to 80° C. | ca. 2 min. |

Processing solution compositions:

<Color developing tank solution>

Benzyl alcohol: 15 ml
Ethylene glycol: 15 ml
Potassium sulfite: 2.0 g
Potassium bromide: 1.3 g
Sodium chloride: 0.2 g
Potassium carbonate: 30.0 g
Hydroxylamine sulfate: 3.0 g
Polyphosphate(TPPS): 2.5 g
3-Methyl-4-amino-N-ethyl-N-(β-methane-sulfonamidoethyl)-aniline sulfate: 5.5 g
Fluorescent whitening agent (4,4'-diaminostilbendisulfonic acid derivative): 1.0 g
Catechol-3,5-disulfonic acid: 0.3 g (made up to total quantity of one liter with addition of water and adjusted to pH 10.00 with KOH).

<Color developing replenishment solution>

Benzyl alcohol: 22 ml
Ethylene glycol: 20 ml
Potassium sulfite: 3.0 g
Potassium carbonate: 30.0 g
Hydroxylamine sulfate: 4.0 g
Polyphosphate (TPPS): 3.0 g
3-Methyl-4-amino-N-ethyl-N-(β-methane-sulfonamido-ethyl)-aniline sulfate: 7.5 g
Fluorescent whitening agent (4,4'-diaminostilbendisulfonic acid derivative): 1.5 g
Catechol-3,5-disulfonic acid: 0.3 g
(made up to total quantity of one liter with addition of water and adjusted to pH 10.50 with KOH).

<Bleach-fixing tank solution>

Ferric ammonium ethylenediaminetetraacetate dihydrate: 60 g
Ethylenediaminetetraacetic acid: 3 g
Ammonium thiosulfate (70% solution): 100 ml
Ammonium sulfite (40% solution): 27.5 ml
(adjusted to pH 7.1 with potassium carbonate or glacial acetic acid, simultaneously with making up to total quantity of one liter with addition of water).

<Bleach-fixing replenishment solution A>

Ferric ammonium ethylenediaminetetraacetate dihydrate: 260 g
Potassium carbonate: 42 g
(made up to total quantity of one liter with addition of water; and adjusted to pH 6.7 with glacial acetic acid or ammonia water).

<Bleach-fixing replenishment solution B>

Ammonium thiosulfate (70% solution): 500 ml
Ammonium sulfite (40% solution): 150 ml
Ethylenediaminetetraacetic acid: 17 g
Glacial acetic acid: 85 ml
(made up to total quantity of one liter; and adjusted to pH 4.6 with glacial acetic acid or ammonia water).

<Water washing-substitutive stabilizing solution and its replenishment solution>

5-Chloro-2-methyl-4-isothiazoline-3-one: 0.03 g
2-Methyl-4-isothizaoline-3-one: 0.03 g
1-Hydroxyethylidene-1,1-diphosphonic acid: 0.5 g/l
Magnesium nitrate: 0.04 g
Ethyl alcohol: 7.0 g
(made up to one liter with water and adjusted to pH 7.0).

EXPERIMENT 1

An automatic processing machine was filled with the above color developing tank solution, the bleach-fixing tank solution and the water washing-substitutive stabilizing solution, and continuous processing was carried out for the above color paper subjected to picture printing exposure while supplementing the color developing replenishment solution and the bleach-fixing replenishment solutions A and B and water washing-substitutive stablizing replenishment solution as described above through quantitating cups at intervals of 3 minutes. The amounts supplemented per 1 $m^2$ of the color paper were 170 ml to the color developing tank, each 25 ml of the bleach-fixing replenishment solutions A and B to the bleach-fixing tank and 200 ml to the stabilizing tank, respectively.

The stabilizing tanks in the automatic processing machine were assembled in a multi-stage countercurrent system, in which the first to the second tanks were arranged in the direction of the flow of the light-sensitive material, supplement being done through the second tank, with the overflow from the second tank being permitted to be flowed into the first tank.

Continuous processing was conducted until the total quantity of the stabilizing solution supplemented became 3-fold of the stabilizing tank volume, and the processed color paper on completion of the continuous processing was recovered as sample. Also, the water washing-substitutive stabilizing solutions in the first and second stabilizing tanks were collected in 2-liter beakers, respectively.

EXPERIMENT 2

The same experiment as Experiment 1 was conducted except that resin columns containing a basic ion-exchange resin Diaion SA-20A (produced by Mitsubishi Kasei Kogyo Co.) were connected directly to the first and second stabilizing tanks so that the processing solutions were circulated respectively therebetween.

EXPERIMENT 3

The same experiment as Experiment 2 was conducted except for changing the color paper in Experiment 2 to a color paper prepared by adding a 0.5 % aqueous solution of a dye shown below to an amount attached after coating of 30 mg/$m^2$ into the green-sensitive emulsion (Third layer) of the color paper of Experiment 2.

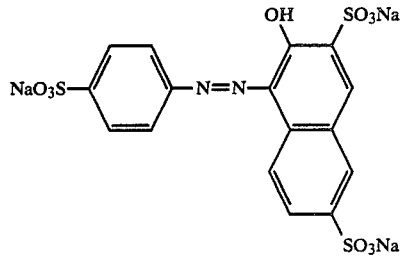

EXPERIMENT 4

The same experiment as Experiment 3 was conducted except for using a color paper in which the dye in Example 3 was changed to the Exemplary compound (B - 20) of this invention.

EXPERIMENT 5

The same experiment as Experiment 2 was conducted except for changing the color paper in Experiment 2 to a color paper prepared by adding a 2 % aqueous solution of the Exemplary compound (A - 1) of this invention to an amount attached after coating of 30 mg/$m^2$ into the red-sensitive emulsion (Fifth layer) of the color paper of Experiment 2.

EXPERIMENT 6

The same experiment as Experiment 4 was conducted except for using a solution prepared by 5 g/liter of ammonium sulfate into the water washing-substitutive stabilizing solution and its replenishment solution in Example 4.

The samples thus processed in Experiments 1 to 6 were deteriorated compulsorily in a thermo-hygrostat tank of 75° C. and 80% RH for 10 days, and thereafter the yellow stain concentration at the unexposed portion was measured with blue light by means of an optical densitometer PDA-65 (produced by Konishiroku Photo Industry Co.)

The water washing-substitutive stabilizing solution in the first and second stabilizing tanks collected respectively were left to stand at room temperature and the appearance of each solution was observed.

The above results are summarized in Table 1.

TABLE 1

| Experiment No. | Yellow stain (blue light) | Storage stability of the water washing-substitutive stabilizing solution (note) First tank (days) 3 | 6 | 9 | 12 | 15 | Second tank (days) 3 | 6 | 9 | 12 | 15 |
|---|---|---|---|---|---|---|---|---|---|---|---|
| 1 (Comparative) | 0.34 | − | − | − | − | − | − | − | − | − | − |
| 2 (Comparative) | 0.21 | + | ++ | ++ | ++ | ++ | + | ++ | ++ | ++ | ++ |
| 3 (Comparative) | 0.27 | + | ++ | ++ | ++ | ++ | + | ++ | ++ | ++ | ++ |
| 4 (This invention) | 0.21 | − | − | − | + | + | − | − | − | + | + |
| 5 (This invention) | 0.21 | − | − | − | + | + | − | − | − | + | + |
| 6 (This invention) | 0.17 | − | − | − | − | + | − | − | − | − | + |

(Note)
−: no floated meterial on liquid surface at all
+: floated material slightly on liquid surface
++: thin film formed on liquid surface From the above Table 1, it can be seen that in the case of using the concentration regulating treatment alone of this invention, although yellow stain may preferably be low, the storage stability of the solution is not sufficient. However, it can be seen that there is a marked effect in improvement of the storage stability of the solution when the compound represented by the formula [I]and [II]of this invention is used in combination.

EXAMPLE 2

EXPERIMENT 7

The same experiments as Experiments 2 and 5 in Example 1 were conducted except for changing the concentration regulating treatment method to the electrodialytic treatment system as described below (Experiments 7-2 and 7-5).

Figure 2:
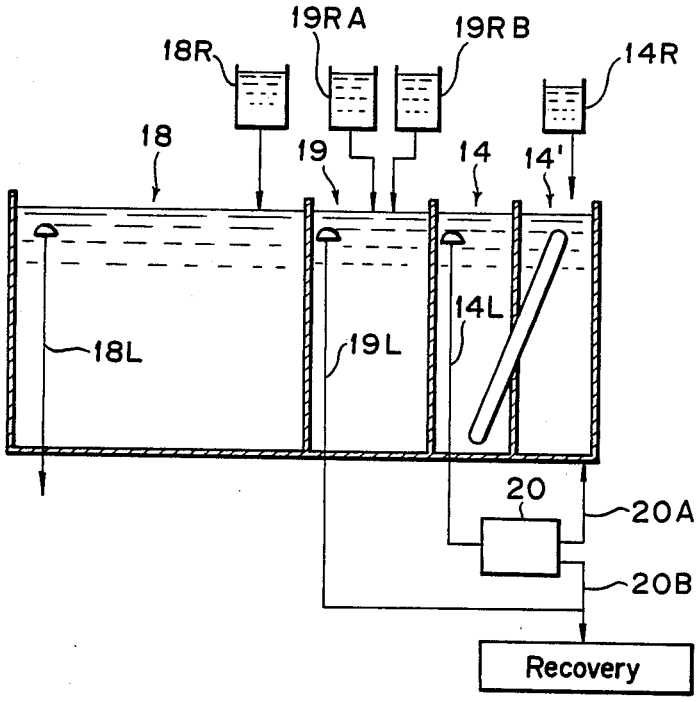
FIG. 2 is a schematic flow chart showing an example of the processing method of this invention by use of a reverse osmosis device.

To the second tank 14' of the stabilizing tanks in the processing device shown in FIG. 2, an electrodialytic device body 1 was directly connected as shown in FIG. 1, and the same experiment as Experiment 1 was conducted while carrying out electrodialytic treatment by use of 0.2 N sodium sulfate as the electrolyte solution, a titanium alloy as the cathode and graphite as the anode, respectively.

In FIG. 1, 2 represents a cathode, 3 an anode, 4 an anion exchange membrane, 5 a cation exchange membrane, 6 a cathode chamber, 7 a desalting chamber, 8 a concentration chamber, 9 an anode chamber, 10 a tank for circulation of electrolyte solution, 11 a circulation pump, 12 a pipeline for circulatron of electrolyte solution (feeding side), 13 the same pipeline for circulation (flow-out side), 15 a circulation pump, 16 a pipeline for circulation of stabilizing solution (feeding side) and 17 the same pipeline for circulation (flow-out side), respectively.

EXPERIMENT 8

The same experiments as Experiment 7 were conducted except for changing the concentration regulating treatment method to the reverse osmotic treatment systems as described below (Experiments 8-2 and 8-5).

As shown in FIG. 2, the overflow of the stabilizing solution from the first tank 14 of the stabilizing tanks is delivered through the overflow discharging pipe 14L to the reverse osmotic treatment device 20, and the diluted solution is returned through the diluting solution discharging pipe 20A to the second tank 14' of the stabilizing tanks. On the other hand, the concentrated solution is delivered through the concentrated solution discharging pipe 20B to the electrolyzed silver recovery device, wherein it is mixed with the overflow of the bleach-fixing solution to recover the electrolyzed silver.

As the reverse osmosis device, a tubular type module produced by Paterson Oandy International Co. having a total of 0.86 $m^2$ of cellulose acetate type semipermeable membranes assembled therein was employed. The overflow of the stabilizing solution was fed through the above semipermeable membranes under a pressure of 55 $kg/cm^2$ at a water passage rate of 4-liter/min. The recovery rate was adjusted to 80 % with rate of water permeation through the membrane being 3.2 liter/min.

EXPERIMENT 9

The same experiments as Experiment 2 in Example 1 were conducted except for changing the ion-exchange column to coconut shell activated charcoal (Experiments 9-1 and 9-5).

In these experiments, the tests for yellow stain and solution storage stability were performed to obtain the results summarized in Table 2.

TABLE 2

| Experiment No. | Yellow stain (blue light) | Storage stability of the water washing-substitutive stabilizing solution (note) First tank (days) 3 | 6 | 9 | 12 | 15 | Second tank (days) 3 | 6 | 9 | 12 | 15 |
|---|---|---|---|---|---|---|---|---|---|---|---|
| 7-2 | 0.23 | − | − | + | ++ | ++ | + | ++ | ++ | ++ | ++ |

TABLE 2-continued

| Experiment No. | Yellow stain (blue light) | Storage stability of the water washing-substitutive stabilizing solution (note) First tank (days) 3 | 6 | 9 | 12 | 15 | Second tank (days) 3 | 6 | 9 | 12 | 15 |
|---|---|---|---|---|---|---|---|---|---|---|---|
| (Comparative) 7-5 | 0.24 | − | − | − | − | + | − | − | − | + | + |
| (This invention) 8-2 | 0.24 | − | − | + | ++ | ++ | − | − | + | ++ | ++ |
| (Comparative) 8-5 | 0.25 | − | − | − | − | − | − | − | − | − | − |
| (This invention) 9-2 | 0.22 | + | ++ | ++ | ++ | ++ | + | ++ | ++ | ++ | ++ |
| (Comparative) 9-5 | 0.22 | − | − | − | + | + | − | − | − | + | + |
| (This invention) | | | | | | | | | | | |

(Note)
The meanings of −, + and ++ are the same as in Table 1.

From the above Table 2, it can be understood that, while the solution storage stability is not sufficient when the concentration regulating treatment method of this invention is used alone, but the solution storage stability can be markedly improved in the presence of the compound represented by the formula [I]of this invention.

EXAMPLE 3

The water washing-substitutive stabilizing solution in the second tank of Experiment 2 of Example 1 was collected in four beakers of one liter capacity, of which one is used as Comparative and each 10 mg of [B - 8], [C - 3]and [D - 8]was added into the other three, an solution was left to stand similarly as Example 1 and its appearance was observed. As the result, the solution to which the compound of this invention was added gave very good result with generation of floating materials being greatly suppressed, as compared with Control to which no such compound was added.

In processing of the light-sensitive material by use of a water washing-substitutive stabilizing solution according to this invention, both of the drawback of increased yellow stain at the unexposed portion after storage for a long term and the drawback of generation of a thin film on the liquid surface when a stabilizing solution is left to stand for a long term can be improved.

We claim:

1. A method for processing a light-sensitive silver halide color photographic material by processing a light-sensitive silver halide color photographic material with a processing solution having a fixing ability and subsequently processing the fixed material with a water washing-substitutive stabilizing solution substantially without carrying out washing with water, which comprises carrying out processsing with the water washing-substitutive stabilizing solution which has been subjected to concentration regulating treatment in the presence of at least one of the compounds represented by the following formulae [I], [II], [II']and [II'']:

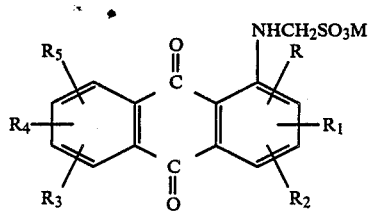

Formula [I]

wherein R, $R_1$, $R_2$, $R_3$, $R_4$ and $R_5$ each represent a hydrogen atom, a halogen atom, a hydroxy group, an alkyl group, an alkoxy group, a sulfo group or —$NHCH_2SO_3M$ (M represents a cation),

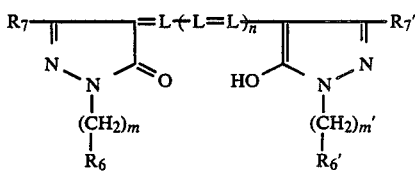

Formula [II]

wherein $R_6$ and $R_6'$ each represent a hydrogen atom, an alkyl group, an aryl group or a heterocyclic group; $R_7$ and $R_7'$ each represent a hydroxy group, an alkoxy group, a substituted alkoxy group, a cyano group, a trifluoromethyl group, —$COOR_8$, —$CONHR_8$, —$NHCOR_8$, an amino group, a substituted amino group substituted with an alkyl group having 1 to 4 carbon atoms or a cyclic amino group represented by the formula:

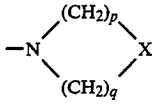

(where p and q each represent 1 or 2, and X represents an oxygen atom, a sulfur atom or —$CH_2$— ); $R_8$ represents a hydrogen atom, an alkyl group or an aryl group; L represents a methyne group; n represents 0, 1 or 2; m and m' each represent 0 or 1,

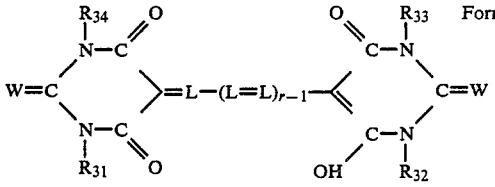

Formula [II']

wherein r represents an integer of 1 to 3; W represents an oxygen atom or a sulfur atom; L represents a methyne group; $R_{31}$ to $R_{34}$ each represent a hydrogen atom, an alkyl group, an aryl group, an aralkyl group or a heterocyclic group, at least one of which is a substituent other than a hydrogen atom, Formula [II'']

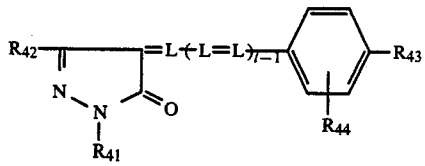

wherein l represents an integer of 1 or 2; L represents a methyne group; $R_{41}$ represents an alkyl group, an aryl group or a heterocyclic group; $R_{42}$ represents a hydroxy group, an alkyl group, an alkoxy group, a substituted alkoxy group, a cyano group, a trifluoromethyl group, —$COOR_8$, —$CONHR_8$, —$NHCOR_8$, an amino group, a substituted amino group substituted with an alkyl group having 1 to 4 carbon atoms or a cyclic amino group represented by the formula:

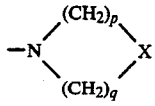

(where p and q each represent 1 or 2, and X represents an oxygen atom, a sulfur atom or —$CH_2$— ); $R_8$ represents a hyrogen atom, an alkyl group or an aryl group; $R_{43}$ represents —$OZ_1$ or

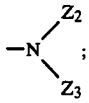

$Z_1$, $Z_2$ and $Z_3$ each represent a hydrogen atom or an alkyl group, $Z_2$ and $Z_3$ being either the same or different or alternatively being bonded to each other to form a ring; and $R_{44}$ represents a hydrogen atom, an alkyl group, a chlorine atom or an alkoxy group.

2. The method according to claim 1, wherein R, $R_1$, $R_2$, $R_3$, $R_4$ and $R_5$ each represent a hydrogen atom, a hydroxy group, —$SO_3M$ or —$NHCH_2SO_3M$ (M represents an alkali metal ion); $R_6$ and $R_6'$ each represent an alkyl group or an aryl group; $R_7$ and R7' each represent an alkoxy group, a cyano group or —$COOR_8$; $R_8$ represents a hydrogen atom or an alkyl group having 1 to 4 carbon atoms; $R_{31}$ to $R_{34}$ each represent a hydrogen atom, an alkyl group or an aryl group: $R_{41}$ and $R_{42}$ each represent an alkyl group or an aryl group; $R_{43}$ represents

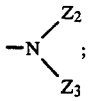

$R_{44}$ represents a hydrogen atom or an alkyl group.

3. The method according to claim 2, wherein R, $R_1$, $R_2$ and $R_4$ each represent a hydrogen atom, a hydroxy group or —$SO_3M$ (M represents a sodium ion or a potassium ion); $R_3$ represents a hydrogen atom or —$NHCH_2SO_3M$ (M is defined as above); $R_5$ represents a hydroxy group or —$NHCH_2SO_3$ M (M is defined as above); $R_6$ and $R_6'$ each represent a phenyl group; $R_7$ and $R_7'$ each represent a cyano group or —$COOR_8$; $R_8$ represents a hydrogen atom or an alkyl group having 1 to 2 carbon atoms; $R_{31}$ to $R_{34}$ each represent an alkyl group having 1 to 4 carbon atoms or a phenyl group; $R_{41}$ and $R_{42}$ each represent a phenyl group; $R_{43}$ represents

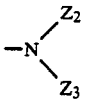

($Z_2$ and $Z_3$ each represent a hydrogen atom or an alkyl group having 1 to 2 carbon atoms); $R_{44}$ represents a hydrogen atom or an alkyl group having 1 to 2 carbon atoms 4. The method according to claim 1, wherein at least one of the systems [A]to [D]shown below is employed. as the concentration regulating treatment method:

System [A]: the system of contacting with an ion-exchange resin;

System [B]: the system of performing electrolysis treatment;

System [C]: the system of performing reverse osmosis treatment;

System [D]: the system of bringing the water washing-substitutive stabilizing solution into contact with at least one of the substances represented by (a) to (i) shown below:

[Contacting substances]

(a) activated charcoal;
(b) clay substance;
(c) polyamide type polymeric compound;
(d) polyurethane type polymeric compound;
(e) phenol resin;
(f) epoxy resin;
(g) polymeric compound having hydrazide group;
(h) polymeric compound containing polytetrafluoroethylene;
(i) copolymer of mono-methacrylate with monohydric or polyhydric alcohol and poly-methacrylate with polyhydric alcohol.

5. The method according to claim 1, wherein the processing solution having fixing ability contains a thiosulfate.

6. The method according to claim 1, wherein the compound represented by the formula [I], [II], [II']or [II'']is incorporated in the light-sensitive material.

7. The method according to claim 1, wherein the compound represented by the formula [I], [II], [II']or [II'']is contained in an amount of 1 to 800 mg per 1 $m^2$ of the light-sensitive silver halide color photographic material.

8. The method according to claim 7, wherein the compound represented by the formula [I], [II], [II']or [II'']is contained in an amount of 2 to 200 mg per 1 $m^2$ of the light-sensitive silver halide color photographic material.

9. The method according to claim 1, wherein the compound represented by the formula [I], [II], [II']or [II'']is added into the water washing-substitutive stabilizing solution in an amount of 0.005 to 200 mg per liter of said solution.

10. The method according to claim 1, wherein the compound represented by the formula [I], [II], [II']or [II'']is selected from the compound represented by the formula [II].

11. The method according to claim 1, wherein the water washing-substitutive stabilizing solution is used in a replenishment rate of 2 liters or less per 1 $m^2$ of the light-sensitive silver halide color photographic material.

12. The method according to claim 11, wherein the water washing-substitutive stabilizing solution is used in a replenishment rate of 1 liter or less per 1 $m^2$ of the light-sensitive silver halide color photographic material.

13. The method according to claim 12, wherein the water washing-substitutive stabilizing solution is used in a replenishment rate of 500 ml or less per 1 $m^2$ of the light-sensitive silver halide color photographic material.

14. The method according to claim 1, wherein the system of contacting with an anion exchange resin is used as the concentration regulating treatment method.

15. The method according to claim 1, wherein the water washing-substitutive stabilizing solution contains a fungicide which is at least one compound selected from the group consisting of hydroxybenzoic acid compounds, alkylphenol compounds, thiazole compounds, pyridine compounds, guanidine compounds, carbamate compounds, morpholine compounds, quaternary phosphonium compounds, ammonium compounds, urea compounds, isoxazole compounds, propanolamine compounds and amino acid compounds.

16. The method according to claim 4, wherein R, $R_1$, $R_2$ and $R_4$ each represent a hydrogen atom, a hydroxy group or $—SO_3M$ (M represents a sodium ion or a potassium ion); $R_3$ represents a hydrogen atom or, $—NHCH_2SO_3M$ (M is defined as above); $R_6$ and $R_6'$ each represent a phenyl group; $R_7$ and $R_7'$ each represent a cyano group or $—COOR_8$; $R_8$ represents a hydrogen atom or an alkyl group having I to 2 carbon atoms; $R_{31}$ to $R_{34}$ each represent an alkyl group having 1 to 4 carbon atoms or a phenyl group; $R_{41}$ and $R_{42}$ each represent a phenyl group; $R_{43}$ represents

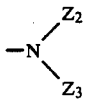

($Z_2$ and $Z_3$ each represent a hydrogen atom or an alkyl group having 1 to 2 carbon atoms); $R_{44}$ represents a hydrogen atom or an alkyl group having 1 to 2 carbon atoms;

the process solution having fixing ability contains a thiosulfate;

the water washing-substitutive stabilizing solution is used in a replenishment rate of 500 ml or less per 1 $m^2$ of the light-sensitive silver halide color photographic material;

the water washing-sybstitutive stabilizing solution contains a fungicide which is at least one compound selected from the group consisting of hydroxybenzoic acid compounds, alkylphenol compounds, thiazole compounds, pyridine compounds, guanidine compounds, carbamate compounds, morpholine compounds, quaternary phosphonium compounds, ammonium compounds, urea compounds, isoxazole compounds, propanolamine compounds and amino acid compounds; and the compound represented by the formula [I], [II], [II']or [II'']is contained in an amount of 2 to 200 mg per 1 m2 of the light-sensitive silver halide color photographic material.

17. The method according to claim 4, wherein R, $R_1$, $R_2$ and $R_4$ each represent a hydrogen atom, a hydroxy group or $—SO_3M$ (M represents a sodium ion or a potassium ion); $R_3$ represents a hydrogen atom or $—NHCH_2SO_3M$ (M is defined as above); $R_5$ represents a hydroxy group or $—NHCH_2SO_3M$ (M is defined as above),; $R_6$ and $R_6'$ each represent a phenyl group; $R_7$ and $R_7'$ each represent a cyano group or $—COOR_8$; $R_8$ represents a hydrogen atom or an alkyl group having 1 to 2 carbon atoms; $R_{31}$ to $R_{34}$ each represent an alkyl group having 1 to 4 carbon atoms or a phenyl group; $R_{41}$ and $R_{42}$ each represent a phenyl group; $R_{43}$ represents

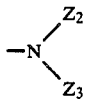

($Z_2$ and $Z_3$ each represent a hydrogen atom or an alkyl group having 1 to 2 carbon atoms); $R_{44}$ represents a hydrogen atom or an alkyl group having 1 to 2 carbon atoms;

the process solution having fixing ability contains a thiosulfate;

the water washing-substitutive stabilizing is used in a replenishment rate of 500 ml or less per 1 m2 of the light-sensitive silver halide color photographic material;

the water washing-substitutive stabilizing solution contains a fungicide which is at least one compound selected from the group consisting of hydrozybenzoic acid compounds, alkylphenol compounds, thiazole compounds, pyridine compounds, guanidine compounds, carbamate compounds, morpholine compounds, quaternary phosphonium compounds, ammonium compounds, urea compounds, isoxazole compounds, propanolamine compounds and amino acid compounds; and the compound represented by the formula [I], [II], [II']or [II'']is added into the water washing-substitutuve stabilizing solution in an amount of 0.01 to 50 mg per liter of said solution.

18. The method according to claim 16, wherein the water washing-substitutive stabilizing solution is used in a replenishment rate of 500 ml or less per 1 $m^2$ of the light-sensitive silver halide color photographic material; and the system of contacting with an anion exchange resin is used as the concentration regulating treatment method.

19. The method according to claim 17, wherein the water washing-substitutive stabilizing solution is used in a replenishment rate of 500 ml or less per 1 m2 of the light-sensitive silver halide color photographic material; and the system of contacting with an anion exchange resin is used as the concentration regulating treatment method.

* * * * *